US008229342B2

(12) United States Patent
Takagi

(10) Patent No.: US 8,229,342 B2
(45) Date of Patent: Jul. 24, 2012

(54) IMAGE FORMING APPARATUS WITH A REVERSING ROLLER HAVING A NON-ARC-SHAPED SURFACE

(75) Inventor: Masaru Takagi, Osaka (JP)

(73) Assignee: Kyocera Mita Corporation (JP)

( * ) Notice: Subject to any disclaimer, the term of this patent is extended or adjusted under 35 U.S.C. 154(b) by 639 days.

(21) Appl. No.: 12/176,478

(22) Filed: Jul. 21, 2008

(65) Prior Publication Data

US 2009/0028619 A1 Jan. 29, 2009

(30) Foreign Application Priority Data

Jul. 27, 2007 (JP) ..... 2007-196393
Jul. 31, 2007 (JP) ..... 2007-199766

(51) Int. Cl.
*G03G 15/00* (2006.01)

(52) U.S. Cl. ..... 399/401; 399/374

(58) Field of Classification Search ..... 399/401, 399/374; 271/65

See application file for complete search history.

(56) References Cited

U.S. PATENT DOCUMENTS 6,669,189 B2 * 12/2003 Seto et al. ..... 271/186
2003/0175060 A1 * 9/2003 Suzuki ..... 399/401
2006/0269339 A1 * 11/2006 Okamoto et al. ..... 399/401
2007/0110489 A1 * 5/2007 Tsuji ..... 399/401
2007/0120305 A1 * 5/2007 Mandel et al. ..... 270/1.01

FOREIGN PATENT DOCUMENTS

| | | | |
|---|---|---|---|
| JP | 2001122494 | | 5/2001 |
| JP | 2001130811 | | 5/2001 |
| JP | 2003-146516 | * | 5/2003 |
| JP | 2003-182907 | | 7/2003 |
| JP | 3440652 | | 8/2003 |
| JP | 2003263090 | | 9/2003 |
| JP | 2005-314024 | * | 11/2005 |

* cited by examiner

*Primary Examiner* — Judy Nguyen
*Assistant Examiner* — Blake A Tankersley
(74) *Attorney, Agent, or Firm* — Gerald E. Hespos; Michael J. Porco

(57) ABSTRACT

An image forming apparatus includes an image forming section for transferring a toner image onto a sheet; a fixing section for fixing the toner image on the sheet; and a reversing section for reversing the sheet front and back. A first pair of rollers conveys a sheet to which a fix processing is applied to the reversing section; a second pair of rollers feeds the sheet from the reversing section by reverse rotation; and a third pair of rollers transfers the sheet back to the image forming section so that an image forming is performed with respect to the back side of the sheet. One roller of the second pair of rollers has on its outer peripheral surface an arc-shaped surface and a non-arc-shaped surface receding inwardly from a circle drawn continuously from the arc-shaped surface.

14 Claims, 10 Drawing Sheets

IMAGE FORMING APPARATUS WITH A REVERSING ROLLER HAVING A NON-ARC-SHAPED SURFACE

BACKGROUND OF THE INVENTION

1. Field of the Invention

The present invention relates to an image forming apparatus which is so configured as to be capable of performing a double-sided printing to a sheet.

2. Description of the Related Art

For example, as disclosed in Japanese Patent No. 3440652, there has been a known sheet-reversing apparatus which is provided in an image forming apparatus and so configured as to be capable of performing a double-sided printing to a sheet. The sheet-reversing apparatus includes a pair of feed-in rollers for feeding the sheet into a reversing section, a pair of reversing rollers provided in the reversing section and capable of reversing a rotational direction, and a pair of feed-out rollers for feeding out a sheet which is reversed front and back, so that a conveying direction of a sheet, to which one-side printing is performed in an image forming section, is reversed by a switch-back method.

According to the image forming apparatus provided with the sheet-reversing apparatus, the sheet bearing a fixed toner image on one side is fed into the reversing section by a normal rotation of the feed-in roller and the reversing roller. After that, the sheet is pulled out of the reversing section by a reverse rotation of the reversing roller and fed out by the feed-out roller toward the image forming section again in a state of being reversed front and back, and then a processing of transferring a toner image performed with respect to a back side of the sheet. The sheet, whose back side having been subjected to the transferring processing, passes through the fixing section again, so that a fixing processing is applied to the sheet again. After that, the sheet is discharged to outside as a sheet having been subjected to the double-sided printing.

Usually, in such sheet-reversing apparatus, if a preceding sheet is not completely pulled out of the reversing section by the driving of the feed-out roller through the pair of reversing rollers, the next sheet cannot be fed into the reversing section, so that a lowering of efficiency in a processing may occur disadvantageously. For the purpose of dealing with such disadvantage, in the sheet-reversing apparatus disclosed in Japanese Patent No. 3440652, one of the pair of reversing roller is separated apart from the other one by driving of a solenoid at a timing when the sheet which is fed into the reversing section temporarily and thereafter pulled out from the reversing section by a reverse rotation of the reversing roller is nipped by the pair of feed-out rollers.

Accordingly, in a state where the pair of feed-out rollers nip the sheet, the sheet can be pulled out from the reversing section only by the driving of the feed-out rollers without especially using the reversing roller. Further, a clearance formed between the pair of reversing rollers enables an operation of feeding the next sheet to the reversing section through the clearance to be performed concurrently with the operation of pulling out the preceding sheet. At this time, the preceding sheet and the next sheet are temporarily present at the same time in the reversing section. Consequently, efficiency in processing a sheet can be improved.

However, using a solenoid to separate one of the pair of reversing rollers apart from the other one causes the number of parts to increase, so that the cost of the apparatus also increase.

Further, a solenoid is not good in response. Thus, in such a case where an operation is not performed appropriately but in delay when one reversing roller should be separated apart from the other reversing roller, a problem may arise in which the next sheet fed into the reversing section may collide with the reversing roller so that a jam may occur.

SUMMARY OF THE INVENTION

An object of the present invention is to provide an image forming apparatus which secures improvement in efficiency in processing a sheet and concurrently realizes a smooth sheet conveyance in the reversing section.

An image forming apparatus in accordance with the present invention which achieves the object includes: an image forming section for transferring a toner image onto a sheet; a fixing section for fixing the toner image transferred onto the sheet; a reversing section for reversing the sheet front and back; a first pair of rollers including a pair of first and second unit rollers forming a first nip portion for causing the sheet, which bears the toner image transferred onto a front side in the image forming section and fixed in the fixing section, to be transferred to the reversing section; a second pair of rollers including third and fourth unit rollers forming a second nip portion, the third unit roller having on its outer peripheral surface an arc-shaped surface and a non-arc-shaped surface receding inwardly from a circle drawn continuously from the arc-shaped surface, the third unit roller adapted for feeding the sheet, which is caused to be transferred to the first pair of rollers, to the reversing section by normal rotation and pulls out the sheet, which is temporarily transferred to the reversing section, from the reversing section by reverse rotation; and a third pair of rollers including fifth and sixth unit rollers forming a third nip portion, the third pair of rollers transferring the sheet to a predetermined conveying passage, which is adapted for putting the sheet back to the image forming section, so that an image forming is performed with respect to the back side of the sheet pulled out by the second pair of rollers from the reversing section.

These and other objects, features and advantages of the present invention will become more apparent upon reading of the following detailed description along with the accompanied drawings.

DETAILED DESCRIPTION OF THE PREFERRED EMBODIMENTS

Figure 1:
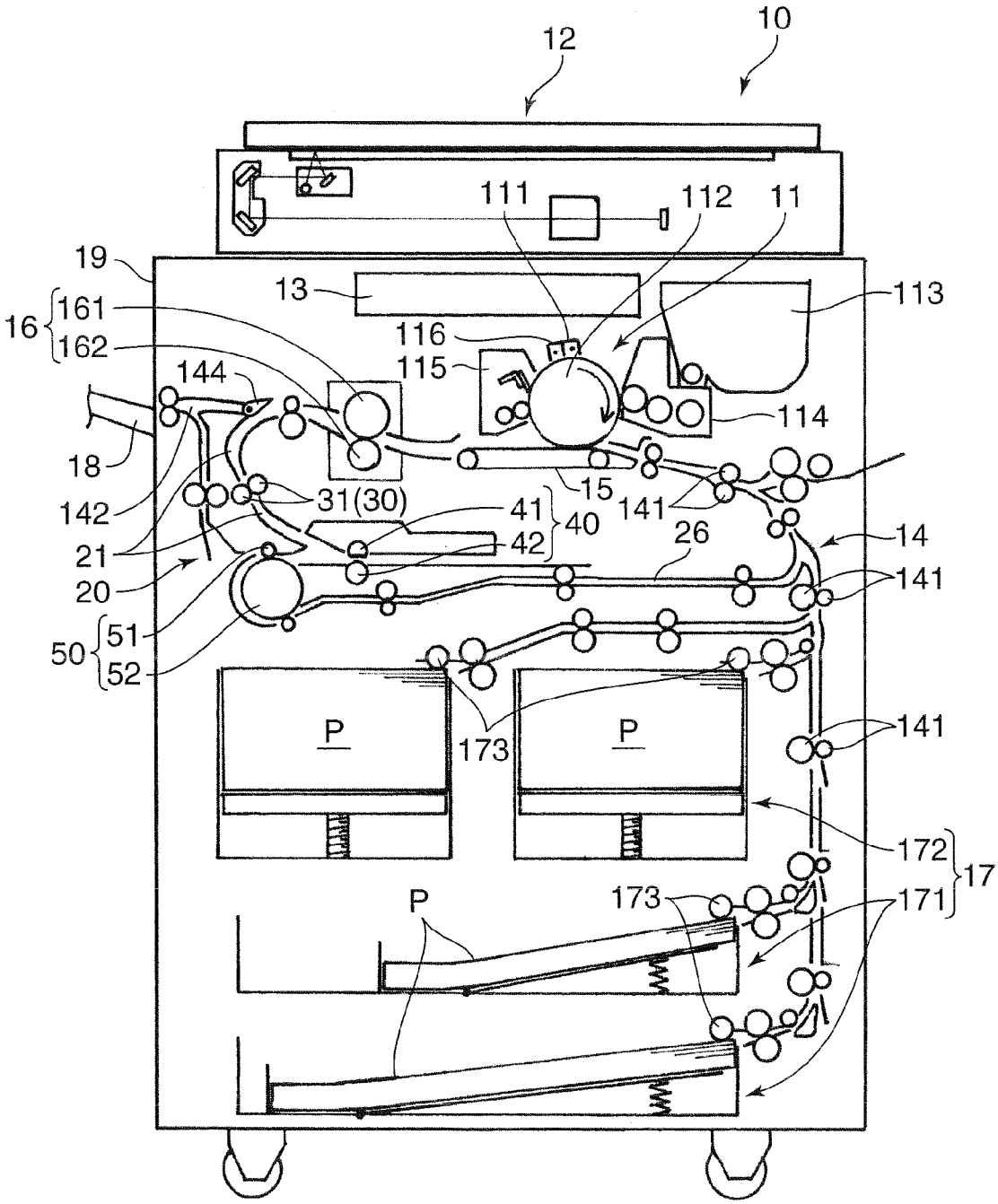
FIG. 1 is a front sectional view showing an image forming apparatus in accordance with an embodiment of the present invention.

FIG. 1 is a front sectional view showing an image forming apparatus 10 in accordance with an embodiment of the present invention. In FIG. 1, a copying machine is shown as an example of the image forming apparatus 10. The image forming apparatus 10 includes an image forming section 11, a fixing device 16 (fixing section), a sheet feeding section 17, a conveying section 20 for a double-sided copying, each of which is accommodated in an apparatus main body 19, and a document reading section 12 arranged on the apparatus main body 19.

When a copying operation is performed in the image forming apparatus 10, a photoconductive drum 112 which is rotated in a direction of an arrow (clockwise direction) shown in the drawing is uniformly charged by a charging device 111 in the image forming section 11, and an electrostatic latent image is formed on the photoconductive drum 112 by a laser beam irradiated from an exposure unit 13 in accordance with document image data read in the document reading section 12. Then, a developing device 113 causes a developer (hereinafter, referred to as toners) to be adhered to the electrostatic latent image so that a toner image is formed. The toners are supplied to the developing device 113 from the toner container 114.

Toward the photoconductive drum 112 on which the toner image is formed, a sheet P is conveyed from the sheet-feeding section 17 to the image forming section 11 via a sheet-conveying passage 14 provided with a plurality of pairs of conveying rollers 141. In the image forming section 11, the toner image bore on a surface of the photoconductive drum 112 is transferred to the sheet P which is conveyed by rotation of a transferring belt 15.

The sheet P to which the toner image is transferred is separated from the photoconductive drum 112 and conveyed to the fixing device 16. The fixing device 16 includes a fixing roller 161 provided with a heat source such as a halogen lamp in its inner portion, and a pressing roller 162 whose peripheral surface comes in press-contact with a peripheral surface of the fixing roller 161. The rollers 161 and 162 form a fixing nip portion therebetween. The sheet P passes through the fixing nip portion, so that a processing of fixing a toner image by heat is applied.

On an upstream side of the charging device 111 along the peripheral surface of the photoconductive drum 112, a cleaning device 115 is provided. Toners remaining on the peripheral surface of the photoconductive drum 112 after being subjected to the transferring processing are scraped off by the cleaning device 115. Further, a charge-removing device 116 is provided between a downstream side of the cleaning device 115 and the charging device 111. The charge-removing device 116 removes an electric charge remaining on the peripheral surface of the photoconductive drum 112.

The sheet P having passed through the fixing device 16 is conveyed to a sheet conveying passage branched in a plurality of directions. Then, a conveying direction of the sheet P is switched by a passage switching mechanism having a passage switching guide. In other words, the sheet P is discharged directly to the sheet-discharging tray 18, or it is conveyed to the conveying section 20 for the double-sided copying to be reversed front and back, put back to the image forming section 11 for double-sided copying again, applied with a fixing processing in the fixing device 16, and thereafter discharged to the sheet-discharging tray 18.

The sheet feeding section 17 includes a plurality sheet cartridges 171 for storing a small number of sheets P, a stocker 172 for stocking a large number of sheets P, and a pickup roller 173 for taking out an uppermost sheet P from a stack of sheets stored in the sheet cartridge 171 and the stocker 172 and feeding the sheet P to the image forming section 11 through the sheet conveying passage 14. The sheet cartridges 171 and the stockers 172 are dismountably mounted to the apparatus main body 19. When the sheets P are consumed to be empty, the sheet cartridges 171 and the stockers 172 are drawn out from the apparatus main body 19, newly supplied with sheets P, and pushed back to the apparatus main body 19.

In the present embodiment, on the way of the sheet-discharging passage 142 extending from the fixing device 16 to the sheet-discharging tray 18, there is provided a branch conveying passage 21 extending toward the conveying section 20 for the double-sided copying on a lower side. At the most upstream position of the branch conveying passage 21, there is provided a switching guide 144 which is rotatable about a predetermined horizontal shaft. The switching guide 144 is so postured as to be horizontal when only one-side printing is performed. The sheet P conveyed from the fixing device 16 passes through the sheet-discharging passage 142 via the switching guide 144 and then is discharged to the sheet-discharging tray 18. On the other hand, when the double-sided printing is performed with respect to the sheet P, the switching guide 144 is so postured as to slant. Accordingly, the sheet P to which the one-side printing is performed and discharged from the fixing device 16 is guided along the lower side of the switching guide 144 toward the branch conveying passage 21. After that, the sheet is conveyed into the conveying section 20 for the double-sided copying.

[First Embodiment]

Figure 2:
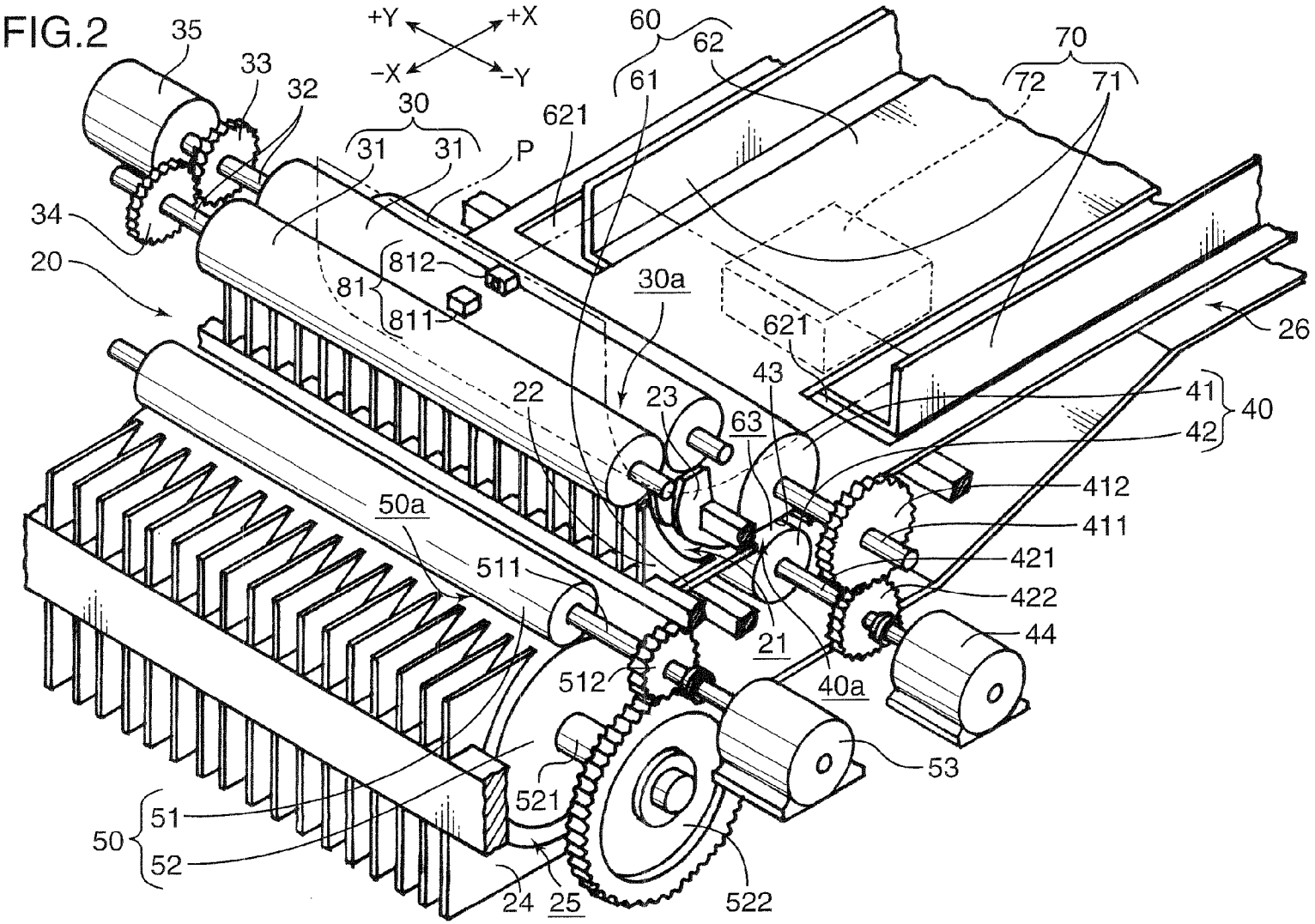
FIG. 2 is a perspective view showing a conveying section for a double-sided copying in accordance with a first embodiment.
Figure 3:
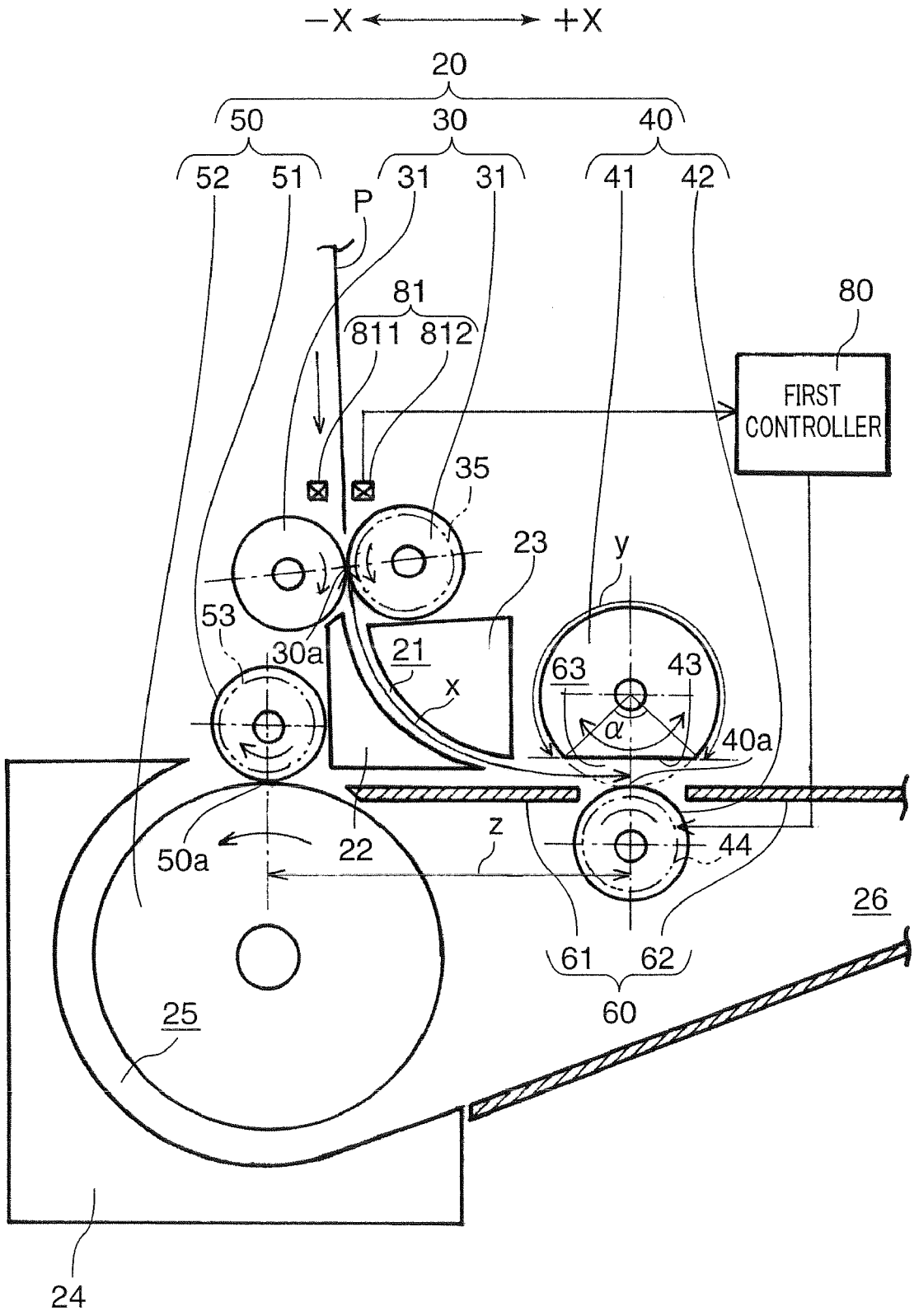
FIG. 3 shows a front view of the conveying section for a double-sided copying shown in FIG. 2.

FIG. 2 is a perspective view showing the conveying section 20 for the double-sided copying in accordance with the first embodiment. FIG. 3 shows a front view of FIG. 2. It should be noted that, in FIGS. 2 and 3, the direction of X−X corresponds to leftward and rightward directions, and the direction of Y−Y corresponds to frontward and rearward directions. Specifically, the direction of −X corresponds to the leftward direction, the direction of +X corresponds to the rightward direction, the direction of −Y corresponds to the frontward direction, and the direction of +Y corresponds to the rearward direction.

The conveying section 20 for the double-sided copying includes a pair of branch rollers 30 (first pair of rollers) provided on an immediate downstream side of the fixing device 16, a pair of reversing rollers 40 (second pair of rollers) provided on a lower right side of the pair of branch rollers 30, a pair of sheet re-feeding rollers 50 (third pair of rollers) provided on a left side of the pair of reversing rollers 40 and substantially immediately under the pair of branch rollers 30, a sheet reversing tray 60 (reversing section) extending rightward from a nip portion (sheet re-feeding nip portion **50*a*; third nip portion) of the pair of sheet re-feeding rollers 50 through a nip portion (reversing nip portion 40*a*; second nip portion ) of the pair of reversing rollers 40, and a lateral position adjusting mechanism 70 (adjusting mechanism) provided on a right side position of the reversing nip portion 40*a* of the sheet reversing tray 60** and adapted for adjusting a conveyance posture of the sheet P.

The pair of branch rollers 30 includes a pair of branch rollers 31 (first and second unit rollers) extending in the frontward and rearward directions and arranged side by side, and the rollers form a nip portion (first nip portion). The branch rollers 31 are supported respectively by branch roller shafts 32 extending coaxially in the frontward and rearward directions with the branch rollers 31 so as to be integrally rotatable. Over one branch roller shaft 32 (one on a right hand in the example shown in FIG. 2), a drive gear 33 is fitted coaxially and integrally rotatably, and over the other branch roller shaft 32, a driven gear 34 is fitted coaxially and integrally rotatably. The drive gear 33 and the driven gear 34 are in mesh with each other.

A driving shaft of a motor 35 for the branch rollers 31 is connected coaxially and integrally rotatably with the branch roller shaft 32 over which the drive gear 33 is fitted. Thus, when the motor 35 for the branch rollers 31 is driven, a drive force of the motor 35 is transmitted to the branch roller shaft 32 on the right hand side, the drive gear 33 integrated fitted over the branch roller shaft 32, and the driven gear 34 which is in mesh with the drive gear 33. Accordingly, the pair of branch rollers 31 are rotated in directions opposite to each other. The sheet P whose leading end arrives at a nip portion of the pair of branch rollers 31 (branch nip portion 30*a*; first nip portion) is conveyed downward by a rotation of the pair of branch rollers 31.

At a position immediately under the pair of branch rollers 30, there are provided a plurality of left guide fins 22 and right guide fins 23. The left guide fins 22 are so shaped as to have a recess whose open side is oriented obliquely in an upper right direction in a front view, and they are arranged in the frontward and rearward directions. The right guide fins 23 are so shaped as to project toward a lower left direction to oppose arc-shaped portions of the left guide fins 22, and they are arranged in the frontward and rearward directions. Between the left and right guide fins 22 and 23, a part of the branch conveying passage 21 under the pair of branch rollers 30 is defined. A downstream end of the branch conveying passage 21 is smoothly connected to an upper surface of the sheet reversing tray 60 at a position on a slightly left side of the reversing nip portion 40*a* (left sheet reversing tray 61).

The pair of reversing rollers 40 causes the sheet P, which is conveyed by the pair of branch rollers 30, to be conveyed to the sheet reversing tray 60 on a right side of the pair of reversing rollers 40 (right sheet reversing tray 62). The pair of reversing rollers 40 includes an upper reversing roller 41 (third unit roller) extending in the frontward and rearward directions and a lower reversing roller 42 (fourth unit roller) so arranged as to oppose to the upper reversing roller 41 on the lower side and extending in the frontward and rearward directions.

The upper reversing roller 41 has on its outer peripheral surface an arc-shaped surface and a non-arc-shaped surface receding inwardly from a circle drawn continuously from the arc-shaped surface. Specifically, the upper reversing roller 41 has a chord surface 43 (non-arc-shaped surface) which extends along an entire length of the upper reversing roller 41 so that a part of the outer peripheral surface, in a state the upper reversing roller 41 is set at an initial orientation, becomes parallel to the conveying direction of the sheet P conveyed on the sheet-reversing tray 60. Therefore, the upper reversing roller 41 has a crescent shape in a front view. As shown in FIG. 3, in the present embodiment, the chord surface 43 is so set that a center angle $\alpha$ of the upper reversing roller 41 becomes 90 degrees in a front view. At a position of curvature center extending in the frontward and rearward directions of the upper reversing roller 41, an upper reversing roller shaft 411 passes through integrally rotatably. Over a front end portion of the upper reversing roller shaft 411, a driven gear 412 is fitted coaxially and integrally rotatably.

The lower reversing roller 42 has, at its center position extending in the frontward and rearward directions, a lower reversing roller shaft 421 extending integrally rotatably. Over a front end position of the lower reversing roller shaft 421, a drive gear 422 is fitted coaxially and integrally rotatably. The drive gear 422 has a diameter which is so set as to allow the drive gear 422 be in mesh with the driven gear 412.

A center axis of the upper reversing roller shaft 411 and a longitudinal axis of the lower reversing roller shaft 421 are set at positions separated apart by a distance corresponding to a sum of a curvature radius of the upper reversing roller 41 and a radius of the lower reversing roller 42.

To a front end of the lower reversing roller shaft 421, a driving shaft of a motor 44 for the reversing rollers is connected coaxially and integrally rotatably. Accordingly, driving of the motor 44 for the reversing rollers is transmitted to the lower reversing roller 42 through the lower reversing roller shaft 421, and to the upper reversing roller 41 through the lower reversing roller shaft 421, the drive gear 422, the driven gear 412, and the upper reversing roller shaft 411, so that the upper and lower unit reversing rollers 41 and 42 are rotated in directions opposite to each other.

The pair of sheet re-feeding rollers 50 is adapted to convey the sheet P, which is pulled out from the sheet reversing tray 60, to a reversing conveying passage 26 formed under the sheet reversing tray 60. The pair of sheet re-feeding rollers 50 includes an upper sheet re-feeding roller 51 (fifth unit roller) having a small diameter, and a lower sheet re-feeding roller 52 (sixth unit roller) having a large diameter extending in frontward and rearward directions. The lower sheet re-feeding roller 52 is provided under the upper sheet re-feeding roller 51 so that the peripheral surface of the lower sheet re-feeding roller 52 comes in contact with the peripheral surface of the upper sheet re-feeding roller 51.

At a center position of the upper sheet re-feeding roller 51, an upper sheet re-feeding roller shaft 511 extending in the frontward and rearward directions passes through integrally rotatably. Over a front end portion of the upper sheet re-feeding roller shaft 511, a drive gear 512 is fitted coaxially and integrally rotatably.

To a front end of the upper sheet re-feeding roller shaft 511, a driving shaft of the motor 53 for the sheet re-feeding rollers is connected coaxially and integrally rotatably. Accordingly, a drive force of the motor 53 for the sheet re-feeding rollers is transmitted to the upper sheet re-feeding roller 51 through the upper sheet re-feeding roller shaft 511, so that the upper sheet re-feeding roller 51 is integrally rotated about the upper sheet re-feeding roller shaft 511 in the clockwise direction in FIG. 2.

The lower sheet re-feeding roller 52 includes a lower sheet re-feeding roller shaft 521 passing through a center position integrally rotatably and extending in the frontward and rearward directions. Over a front end position of the lower sheet re-feeding roller shaft 521, a driven gear 522 is fitted coaxially and integrally rotatably. The driven gear 522 has a diameter which is so set as to allow the driven gear 522 be in mesh with the drive gear 512. Thus, if the motor 53 for the sheet re-feeding rollers is driven in the clockwise direction, a drive force is transmitted to the clockwise rotation of the upper sheet re-feeding roller 51 directly through the upper sheet re-feeding roller shaft 511, and to the lower sheet re-feeding roller 52 through the drive gear 512, the driven gear 522, and the lower sheet re-feeding roller shaft 521. Accordingly, the lower sheet re-feeding roller 52 is rotated in the counter-clockwise direction about the lower sheet re-feeding roller shaft 521.

The peripheral surfaces of the upper sheet re-feeding roller 51 and the lower sheet re-feeding roller 52 come in contact with each other, so that a sheet re-feeding nip portion 50*a* (third nip portion) is formed at the contact position. The sheet P which is conveyed temporarily to the right sheet reversing tray 62 and then pulled out from the right sheet reversing tray 62 by the driving of the pair of reversing rollers 40 is conveyed to the reversing conveying passage 26 through the sheet re-feeding nip portion 50*a*.

On a left side of the lower sheet re-feeding roller 52, a plurality of semicircular fins 24 are provided so as to align in the frontward and rearward directions at a predetermined pitch. Between the semicircular end portions of the plurality of semicircular fins 24 and the peripheral surface of the lower sheet re-feeding roller 52, a semicircular conveying passage 25 for allowing a sheet P to pass through is formed. Thus, the sheet P conveyed leftward from the sheet re-feeding nip portion 50*a* by the rotation of the pair of sheet re-feeding rollers 50 is caught by the semicircular fins 24 and thereafter conveyed to the reversing conveying passage 26 through the semicircular conveying passage 25.

As shown in FIG. 3, the sheet reversing tray 60 includes the left sheet reversing tray 61 and the right sheet reversing tray 62. The left sheet reversing tray 61 is positioned immediately under the pair of branch rollers 30, and its vertical level is so set that an upper surface is on a plane which is the same as that of the sheet re-feeding nip portion 50*a*. The right sheet reversing tray 62 is positioned on a right side of the pair of reversing rollers 40, and its upper surface is at a vertical level on a plane which is the same as that of the upper surface of the left sheet reversing tray 61.

Between a right end portion of the left sheet reversing tray 61 and a left end portion of the right sheet reversing tray 62, a clearance 63 is formed to allow the upper reversing roller 41 and the lower reversing roller 42 of the pair of reversing rollers 40 to oppose to each other. Thus, in a state where the upper reversing roller 41 is set to be in a conveying posture, the peripheral surface of the upper reversing roller 41 and the peripheral surface of the lower reversing roller 42 come in contact with each other through the clearance 63. In other words, the reversing nip portion 40*a* (second nip portion) is formed.

In a state where the upper reversing roller 41 is in a passing posture in which the chord surface 43 is so postured as to be parallel to the sheet conveying direction (it is horizontal in the present embodiment), the reversing nip portion 40*a* is disappears, and a clearance is defined between the chord surface 43 of the upper reversing roller 41 and the peripheral surface of the lower reversing roller 42. Thus, the sheet P conveyed through the branch conveying passage 21 by the driving of the pair of branch rollers 30 while being guided by the left guide fins 22 passes through the clearance between the peripheral surfaces of the chord surface 43 and the lower reversing roller 42 and then is conveyed to the right sheet reversing tray 62.

From this state, if the pair of reversing rollers 40 are so driven as to move the sheet P rightward in a state where a rear end of the sheet P is out of the branch nip portion 30*a* of the pair of branch rollers 30, the sheet P receives a conveyance force from the reversing nip portion 40*a* of the pair of reversing rollers 40, so that the sheet P is conveyed toward the right sheet reversing tray 62 by a predetermined distance (specifically, a distance by one rotation of the upper reversing roller 41). By a subsequent reverse rotation of the upper and lower reversing rollers 41 and 42, the sheet P is pull from the right sheet reversing tray 62. Then, the sheet P passes through the upper surface of the left sheet reversing tray 61 and proceeds to the sheet re-feeding nip portion 50*a*. After that, the sheet P passes through the semicircular conveying passage 25 and the reversing conveying passage 26, and then is put back to the image forming section 11.

The lateral position adjusting mechanism 70 is adapted to adjust an oblique passing of the sheet P (oblique conveyance), and it performs an adjustment of the oblique passing (adjustment of a lateral position) at a timing when the sheet P is conveyed to the right sheet reversing tray 62. Such timing is referred because when the conveyance of the sheet P to the right sheet reversing tray 62 is completed, the upper reversing roller 41 is set to be in a passing posture in which the chord surface 43 faces downward, and since the nipping by the pair of reversing rollers 40 is released in such state, the sheet P can be freely moved in a lateral direction (direction perpendicular to the conveying direction).

The lateral position adjusting mechanism 70 includes a pair of moving cursors 71 provided on the right sheet reversing tray 62 and arranged in the frontward and rearward directions, and a movement applying mechanism 72 for applying a movement toward the frontward and rearward directions to each of the moving cursors 71. The pair of moving cursors 71 project upward through a pair of guide openings 621 which are so formed as to extend in the leftward and rightward directions on opposite end portions of the right sheet reversing tray 62 in the frontward and rearward directions, so that the pair of moving cursors 71 can move in the directions opposite to each other. The movement applying mechanism 72 is provided on a back side of the right sheet reversing tray 62 so as to move the pair of moving cursors 71 in the frontward and rearward directions by using a predetermined driving mechanism.

The lateral position adjusting mechanism 70, in a state where the sheet P is conveyed to the right sheet reversing tray 62, moves the pair of moving cursors 71 in the frontward and rearward directions by the driving of the movement applying mechanism 72. This movement causes the sheet P to be moved by the opposing surfaces of the pair of moving cursors 71, so that the oblique passing can be adjusted.

As shown in FIG. 3, in the conveying section 20 for the double-sided copying which is so configured as described above, a first distance x of an arc-shaped line between the branch nip portion 30*a* and the reversing nip portion 40*a* is set to be greater than an arc length y of the upper reversing roller 41 ($x>y$). Thus, by rotating the upper reversing roller 41, which is set to be in the passing posture, in the counter-clockwise direction about the upper reversing roller shaft 411 (normal rotation) immediately after the rear end of the sheet P is out of the branch nip portion 30*a* (in other words, the chord surface 43 faces downward), the sheet P whose rear end is out of the branch nip portion 30*a* is conveyed by the driving of the pair of reversing rollers 40, and then is stopped in a state where the rear end does not arrive at the reversing nip portion 40*a*. At this time, the upper reversing roller 41 is in the original passing posture. In this state, the lateral position adjusting mechanism 70 is driven.

Further, in the present embodiment, a second distance z of a line between the reversing nip portion 40*a* and the sheet re-feeding nip portion 50*a* is set to be greater than the arc length y of the upper reversing roller 41 ($y<z$). Thus, when a leading end, which was previously a rear end, of the sheet P arrives at the sheet re-feeding nip portion 50*a* by continuously performed one rotation of the upper reversing roller 41 about the upper reversing roller shaft 411 in the clockwise direction, the sheet P does not fall in a state of being nipped by both of the pair of reversing rollers 40 and the pair of sheet re-feeding rollers 50, and it is nipped only by the sheet re-feeding nip portion 50*a*. Thus, the sheet P is not damaged disadvantageously due to a concurrent nipping at a close distance and a difference in a conveyance speed, and can be smoothly conveyed.

As an example of the distances, the first distance x may be 100 mm, and the second distance z may be 90 mm, and the arc length y of the upper reversing roller 41 may be 60 mm ($x>y<z$).

The image forming apparatus 10 having such conveying section 20 for the double-sided copying is provided with a first controller 80 (FIG. 3) having a microcomputer for controlling various operations of the image forming apparatus 10. The first controller 80 is programmed so as to control an operation of the conveying section 20 for the double-sided copying. However, hereinafter, a control with respect to the pair of reversing rollers 40 will be described.

In the present embodiment, for the purpose of controlling the driving of the pair of reversing rollers 40 by the first controller 80, there is provided a sheet rear end sensor 81 (first sensor) at a position immediately above the branch nip portion 30*a* of the pair of branch rollers 30 for detecting whether a rear end of the sheet P which is to be conveyed by the pair of branch rollers 30 passes through the branch nip portion 30*a*. The sheet rear end sensor 81 is an optical sensor including a light emitting section 811 having a light emitting device and a light receiver 812 having a light receiving device for receiving a light from the light emitting section 811. The light emitting section 811 and the light receiver 812 are so arranged as to opposite to each other at a position immediately above the branch nip portion 30*a* and across the branch conveying passage 21.

When the sheet P passes through a space between the light emitting section 811 and the light receiver 812, irradiation of light from the light emitting section 811 to the light receiver 812 is temporarily interrupted. When the rear end of the sheet P passes through the space, the light irradiated from the light emitting section 811 is received by the light receiver 812 again. The received light signal is inputted as a detection signal to the first controller 80.

The first controller 80 stores a time (adjustment time) which is calculated based on a conveyance speed of the sheet P and taken between the detection of the rear end of the sheet P by the sheet rear end sensor 81 and the reaching of the rear end to the branch nip portion 30*a*. After elapse of the adjustment time, the first controller 80 gives a control signal, which is adapted for rotating the upper reversing roller 41 by one rotation in the counter-clockwise direction in FIG. 3, to the motor 44 for the reversing rollers.

The motor 44 for the reversing rollers, after receiving the control signal from the first controller 80, drives the upper reversing roller 41 to rotate by one rotation in the counter-clockwise direction (the lower reversing roller 42 rotates in the clockwise direction). Therefore, the sheet P is conveyed toward the right sheet reversing tray 62 by the arc length y of the upper reversing roller 41. Then, after the chord surface 43 falls in a state of opposing to the lower reversing roller 42, a processing of correcting the oblique passing of the sheet P is performed by the lateral position adjusting mechanism 70.

After that, in accordance with the control signal from the first controller 80, the upper reversing roller 41 is rotated by one rotation in the clockwise direction in FIG. 3 (the lower reversing roller 42 is rotated in the counter-clockwise direction). Accordingly, the sheet P is pulled out from the right sheet reversing tray 62 toward the sheet re-feeding nip portion 50*a* of the pair of sheet re-feeding rollers 50. Then, since the second distance z is so set as to be greater than the arc length y of the upper reversing roller 41 in a state where the upper reversing roller 41 is set to be in a passing posture (in other words, in a state where the chord surface 43 of the upper reversing roller 41 becomes horizontal), the sheet P is nipped at its leading end by the sheet re-feeding nip portion 50*a* of the pair of sheet re-feeding rollers 50. Thereafter, the sheet P is put back to the image forming section 11 through the semi-circular conveying passage 25 and the reversing conveying passage 26.

Figure 4A:
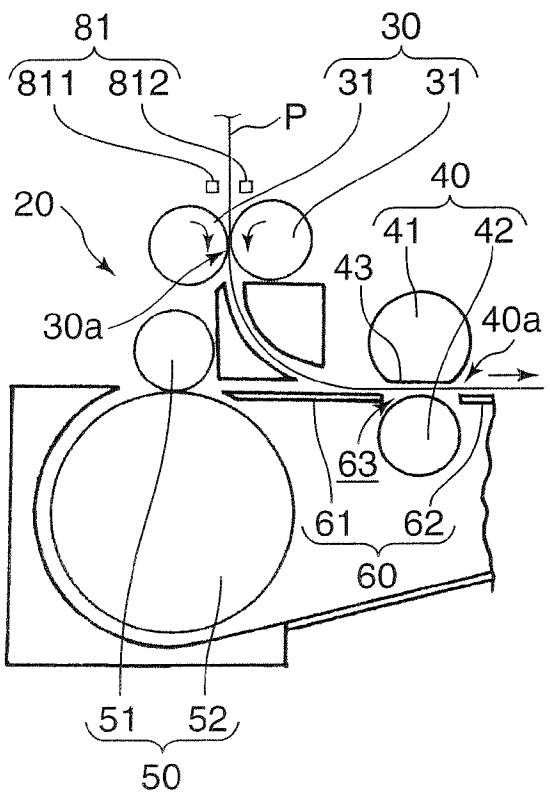
FIGS. 4A-4C show an operation of the conveying section for a double-sided copying in accordance with the first embodiment.
Figure 4B:
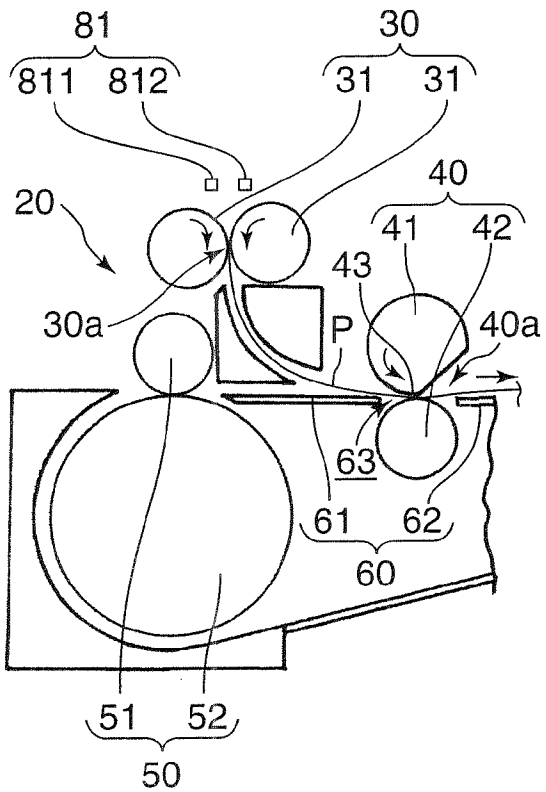
Figure 4C:
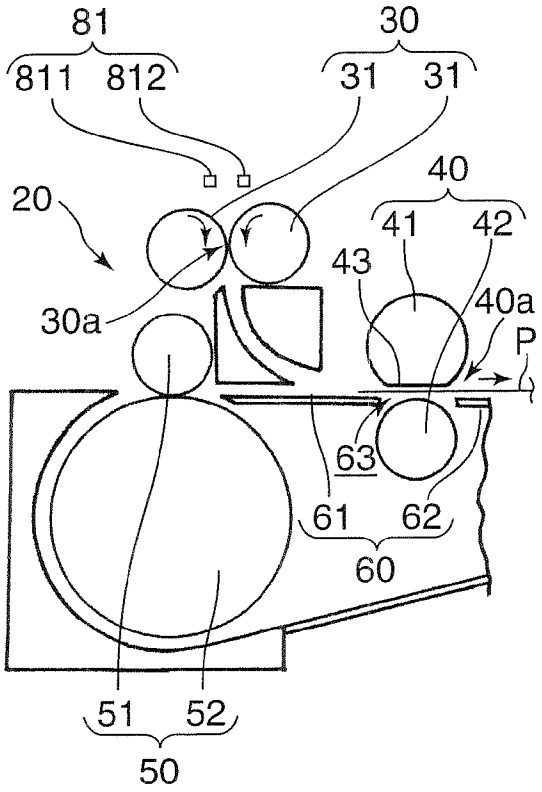

Hereinafter, an operation of the conveying section 20 for the double-sided copying will be described with reference to FIGS. 4 and 5, and with reference to FIGS. 1-3 as needed. FIGS. 4A-4C and 5A-5C show an operation of the conveying section 20 for the double-sided copying. FIG. 4A shows a state where the sheet P is conveyed by the pair of branch rollers 30 to pass through the clearance between the pair of reversing rollers 40, and the leading end of the sheet P starts to enter the right sheet reversing tray 62. FIG. 4B shows a state where detection of the rear end of the sheet P causes the upper reversing roller 41 to start rotating in the counter-clockwise direction. FIG. 4C shows a state where the upper reversing roller 41 is rotated by one rotation, and the sheet P is temporarily conveyed to the right sheet reversing tray 62.

Figure 5A:
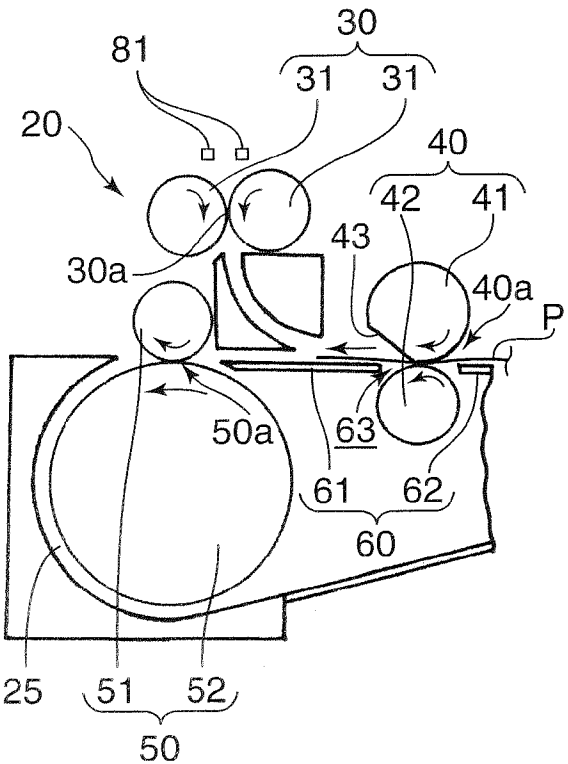
FIGS. 5A-5C show an operation of the conveying section for a double-sided copying in accordance with the first embodiment.

FIG. 5A shows a state where the upper reversing roller 41 starts to rotate in the clockwise direction. FIG. 5B shows a state where the upper reversing roller 41 rotates in the clockwise direction by one rotation, and thereafter the next sheet P is conveyed to the right sheet reversing tray 62 through the clearance between the pair of reversing rollers 40. FIG. 5C shows a state where the previous leading end (a new rear end) of the first sheet P arrives at the sheet re-feeding nip portion 50*a*, and the rear end of the next sheet P arrives at the branch nip portion 30*a*.

As shown in FIG. 4A, the sheet P which is a first page of a print job and on its front side a printing processing is applied is conveyed to the right sheet reversing tray 62 by the rotation of the pair of branch rollers 30. At this time, the upper reversing roller 41 is stopped while its chord surface 43 facing downward to oppose to the peripheral surface of the lower reversing roller 42, and the sheet P passes through the position of the pair of reversing rollers 40 without being nipped by the pair of reversing rollers 40. In other words, the sheet P is in a state of being conveyed to the right sheet reversing tray 62 only by the rotation of the pair of branch rollers 30. At this time, the pair of sheet re-feeding rollers 50 is also stopped.

After that, when the sheet rear end sensor 81 detects the rear end of the sheet P, the detection result is inputted to the first controller 80 (FIG. 3). When the detection result is inputted, the first controller 80 transmits a drive signal for causing a normal rotation (rotation in the counter-clockwise direction) of the upper reversing roller 41 to the motor 44 for the reversing rollers (FIG. 3) at a timing delaying by a predetermined time. Accordingly, the upper reversing roller 41 starts to rotate in the counter-clockwise direction, as shown in FIG. 4B. Subsequently, the sheet P gets out of the branch nip portion 30*a* and is conveyed toward the right sheet reversing tray 62 by a conveyance force of the pair of reversing rollers 40.

Then, when the upper reversing roller 41 rotates by one rotation about the upper reversing roller shaft 411 in the counter-clockwise direction, the upper reversing roller 41 is stopped in accordance with the control signal from the first controller 80, as shown in FIG. 4C. Accordingly, the sheet P moves by the arc length y (FIG. 3) of the upper reversing roller 41 from the state shown in FIG. 4B. However, since the arc length y of the upper reversing roller 41 is set to be smaller than the first distance x (FIG. 3), the rear end (left end in FIG. 4) of the sheet P does not get out of the reversing nip portion 40*a*.

In this state, according to the present embodiment, the lateral position adjusting mechanism 70 (FIG. 2) is driven, so that the movement of the pair of moving cursors 71 sandwiching the sheet P adjusts the oblique passing (skew) of the sheet P.

Next, the first controller 80 transmits a driving signal for reversely rotating (rotation in the clockwise direction) the upper reversing roller 41 to the motor 44 for the reversing rollers. Accordingly, as shown in FIG. 5A, the upper reversing roller 41 is rotated in the clockwise direction. Obviously, the lower reversing roller 42 is rotated in the counter-clockwise direction about the lower reversing roller shaft 421. Concurrently, the pair of sheet re-feeding rollers 50 are also rotated. Accordingly, the sheet P is reversely conveyed, pulled out from the right sheet reversing tray 62, and then conveyed straightly to the sheet re-feeding nip portion 50*a* formed between the upper and lower unit sheet re-feeding rollers 51 and 52.

Figure 5B:
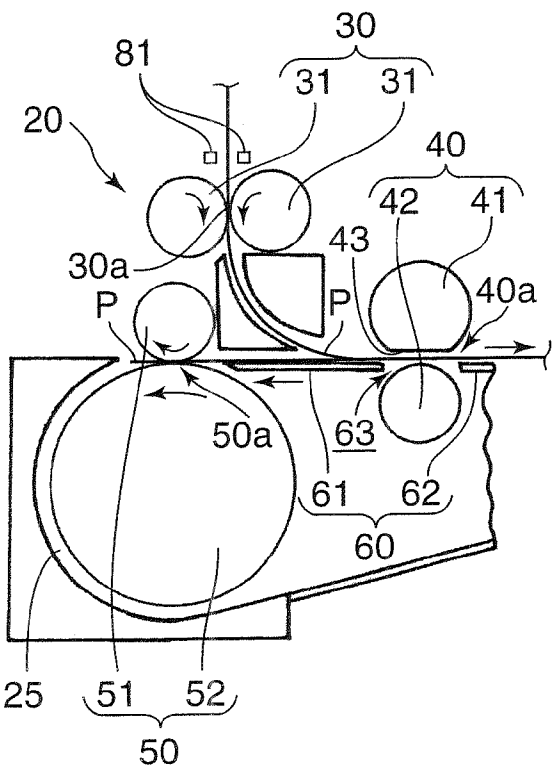

As shown in FIG. 5B, the pair of reversing rollers 40 is stopped when the upper reversing roller 41 rotates by one rotation to be in the original passing posture. After that, the sheet P does not receive a conveyance force from the pair of reversing rollers 40, and it is conveyed only by a force applied by the pair of sheet re-feeding rollers 50.

Here, at a timing when the leading end (which was previously the rear end) of the sheet P which is reversely conveyed arrives at the sheet re-feeding nip portion 50*a* of the pair of sheet re-feeding rollers 50 as shown in FIG. 5B, the second sheet P is fed to the pair of reversing rollers 40 by the pair of pair of branch rollers 30. Accordingly, even though the first sheet P is still not completely pulled out of the right sheet reversing tray 62, the second sheet P is conveyed to the right sheet reversing tray 62.

At this time, the chord surface 43 of the upper reversing roller 41 faces downward to be set in the passing posture, and the clearance 63 is formed between the chord surface 43 and the peripheral surface of the lower reversing roller 42. Therefore, the second sheet P passes through the clearance 63 to enter the right sheet reversing tray 62 while slipping on the upper surface of the first sheet P. Such situation is the same as the situation shown in FIG. 4A if the second sheet P is identified as the first sheet.

Figure 5C:
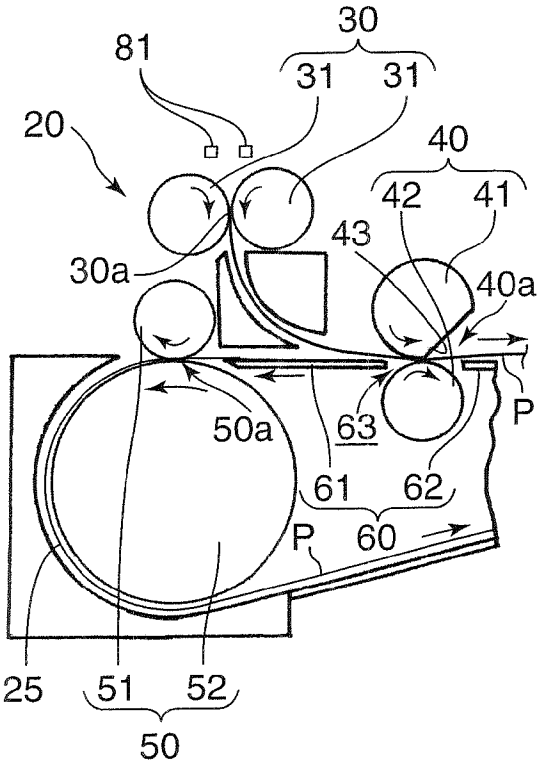

Next, when the rear end of the second sheet P arrives at the branch nip portion 30*a* of the pair of branch rollers 30, as shown in FIG. 5C, the upper reversing roller 41 starts a normal rotation. Accordingly, the second sheet P is conveyed only by the pair of reversing rollers 40 later on. Such situation is the same as that shown in previous FIG. 4B. At this time, the conveyance of the first sheet P toward the reversing conveying passage 26 (FIG. 2) through the semicircular conveying passage 25 is performed, and the downstream end arrives at the sheet re-feeding nip portion 50*a*.

After that, the third and subsequent sheet P are fed sequentially to the conveying section 20 for the double-sided copying, so that the operations of the pair of branch rollers 30, the pair of reversing rollers 40, and the pair of sheet re-feeding rollers 50 are repeated. Accordingly, the double-sided printing processing with respect to the sheet P using the conveying section 20 for the double-sided copying is performed efficiently.

As described above in detail, the image forming apparatus 10 in accordance with the present embodiment includes the image forming section 11 for forming a toner image on the sheet P, the fixing device 16 for fixing the toner image on the sheet P, the pair of branch rollers 30 for conveying the sheet P to the sheet reversing tray 60 to reverse the sheet P front and back, the pair of reversing rollers 40 for conveying the sheet P to the sheet reversing tray 60 by a normal rotation and pulling out from the sheet reversing tray 60 the sheet P conveyed temporarily to the sheet reversing tray 60 by the reverse rotation, and the pair of sheet re-feeding rollers 50 for putting back the sheet P to the image forming section 11 so that an image forming processing is applied to the back side of the sheet P pulled out from the sheet reversing tray 60. Then, the upper reversing roller 41, which is one of the pair of reversing rollers 40, has the chord surface 43 which is so formed as to extend along the flat surface parallel to the direction in which the axis of the upper reversing roller 41 extends.

According to this configuration, at a point of time when the first sheet P is taken out from the sheet reversing tray 60 by the reverse rotation of the pair of reversing rollers 40 and nipped by the pair of sheet re-feeding rollers 50, if rotation of the pair of reversing rollers 40 are controlled so that the chord surface 43 becomes parallel to the sheet conveying direction, the second sheet P can be conveyed to the sheet reversing tray 60 through the clearance between the chord surface 43 of the upper reversing roller 41 and the peripheral surface of the lower reversing roller 42 at a point of time when the first sheet P is not completely pulled out from the sheet reversing tray 60. In other words, the first and second sheets P which are conveyed in opposite directions may present on the sheet reversing tray 60 at the same time. Therefore, efficiency in processing the sheet P can be improved.

Further, the structure which enables the two sheets P to be on the sheet reversing tray 60 at the same time can be realized by forming the chord surface 43, in other words, forming the upper reversing roller 41 so as to have a crescent shape in an end view. Therefore, it is not necessary increase the number of parts, unlike the conventional manner where the upper reversing roller is separated apart from the lower reversing roller by driving of a solenoid. Therefore, it can contribute to a cost reduction in the apparatus, and a problem of delay in a response of the solenoid can be solved.

In the present embodiment, sizes of parts are so set as to meet a mathematical relation of $x>y<z$, where x is a distance between the first nip portion 30*a* of the pair of branch rollers 30 and the reversing nip portion 40*a* of the pair of reversing rollers 40, y is the arc length of the upper reversing roller 41, and z is a distance between the reversing nip portion 40*a* and the sheet re-feeding nip portion 50*a* of the pair of sheet re-feeding rollers 50.

According to this configuration, since the mathematical relation of $x>y$ is met, the rear end of the sheet P is positioned on an upstream side of the reversing nip portion 40*a* at a time when the pair of reversing rollers 40 rotate by one rotation. Thus, at a time when the reverse rotation of the pair of reversing rollers 40 is subsequently performed, a defect in nipping, in other words, a disadvantage such that the sheet P is not nipped due to its non-presence, can be prevented from occurring. Further, since the mathematical relation of $y<z$ is met, the sheet P can be prevented from being nipped by the reversing nip portion 40*a* and the sheet re-feeding nip portion 50*a* concurrently. This prevents occurrence of a disadvantage that the sheet P is wrinkled or broken by a load exerted due to the difference in rotational speeds of the rollers 40 and 50.

There are provided the sheet rear end sensor 81 for detecting whether the rear end of the sheet P passes through the branch nip portion 30*a*, and the first controller 80 for outputting a control signal in accordance with the detection result of the sheet rear end sensor 81 for the normal rotation of the pair of reversing rollers 40. Therefore, at a timing when the sheet rear end sensor 81 detects the rear end of the sheet P, the first controller 80 outputs a control signal for normally rotating the pair of reversing rollers 40. Accordingly, the sheet P can be conveyed automatically to the sheet reversing tray 60 by one rotation of the pair of reversing rollers 40.

Further, the pair of reversing rollers 40 have such diameters that after the sheet rear end sensor 81 detects the rear end of the sheet P, and the pair of reversing rollers 40 are rotated by one rotation, the rear end of the sheet P is to be positioned on an immediate upstream side of the reversing nip portion 40*a* of the pair of reversing rollers 40. Thus, only one rotation of the pair of reversing rollers 40 causes the rear end of the sheet P to be positioned on an immediate upstream side of the reversing nip portion 40*a*. Therefore, as compared to the case where the rear end of the sheet P is positioned on an immediate upstream side of the reversing nip portion 40*a* by less than one rotation or plurality of rotations, a structure for conveying the sheet P and a control for conveyance can be simplified.

Further, there is provided the lateral position adjusting mechanism 70 for adjusting a lateral position of the sheet P guided to the sheet reversing tray 60. Therefore, the oblique passing of the sheet P conveyed to the sheet reversing tray 60 can be adjusted by the lateral position adjusting mechanism 70.

The first embodiment of the present invention is described above. However, the first embodiment may take the following modifications.

(1) In the embodiment described above, a copying machine is described as an example of the image forming apparatus 10. However, the present invention is not limited to this. The image forming apparatus 10 may be a printer, a facsimile machine, or the like.

(2) In the embodiment described above, the motor 35 for the branch rollers 31 is provided to drive the pair of branch rollers 30, and the motor 53 for the sheet re-feeding rollers is provided to drive the pair of sheet re-feeding rollers 50. Alternatively, a drive force of one drive motor may be transmitted to both the pair of branch rollers 30 and the pair of sheet re-feeding rollers 50 through a predetermined gear mechanism. Since the motor 44 for the reversing rollers needs to be rotated in the forward and reverse directions, the motor 35 for the branch rollers 31 which performs only the normal rotation and the motor 53 for the sheet re-feeding rollers cannot be shared.

(3) In the embodiment described above, the chord surface 43 is formed on the upper reversing roller 41 which is one of the pair of reversing rollers 40. Instead, the chord surface 43 may be formed on the lower reversing roller 42. Further, not limited to the chord surface 43, any shape in which the radial distance is smaller than the arc-shaped surface of the upper reversing roller 41 (non-arc-shaped surface) may be adopted.

(4) In the embodiment described above, the pair of reversing rollers 40 are normally or reversely driven in accordance with a condition of the sheet P to be conveyed. Alternatively, the pair of reversing rollers 40 may be driven only at a time when the sheet P conveyed to the right sheet reversing tray 62 is conveyed out to the pair of sheet re-feeding rollers 50.

(5) In the embodiment described above, an optical sensor having the light emitting section 811 and the light receiver 812 is provided as the sheet rear end sensor 81. Alternatively, a mechanically configured part such as a limit switch may be adopted in which a striker is kicked due to a presence of sheet P.

(6) In the embodiment described above, the upper reversing roller 41 is so formed as to have a shape of crescent in an end view. However, while it has a circular shape in an end surface, a mid portion in the longitudinal direction may have a shape of crescent in a cross sectional view.

[Second Embodiment]

Figure 6:
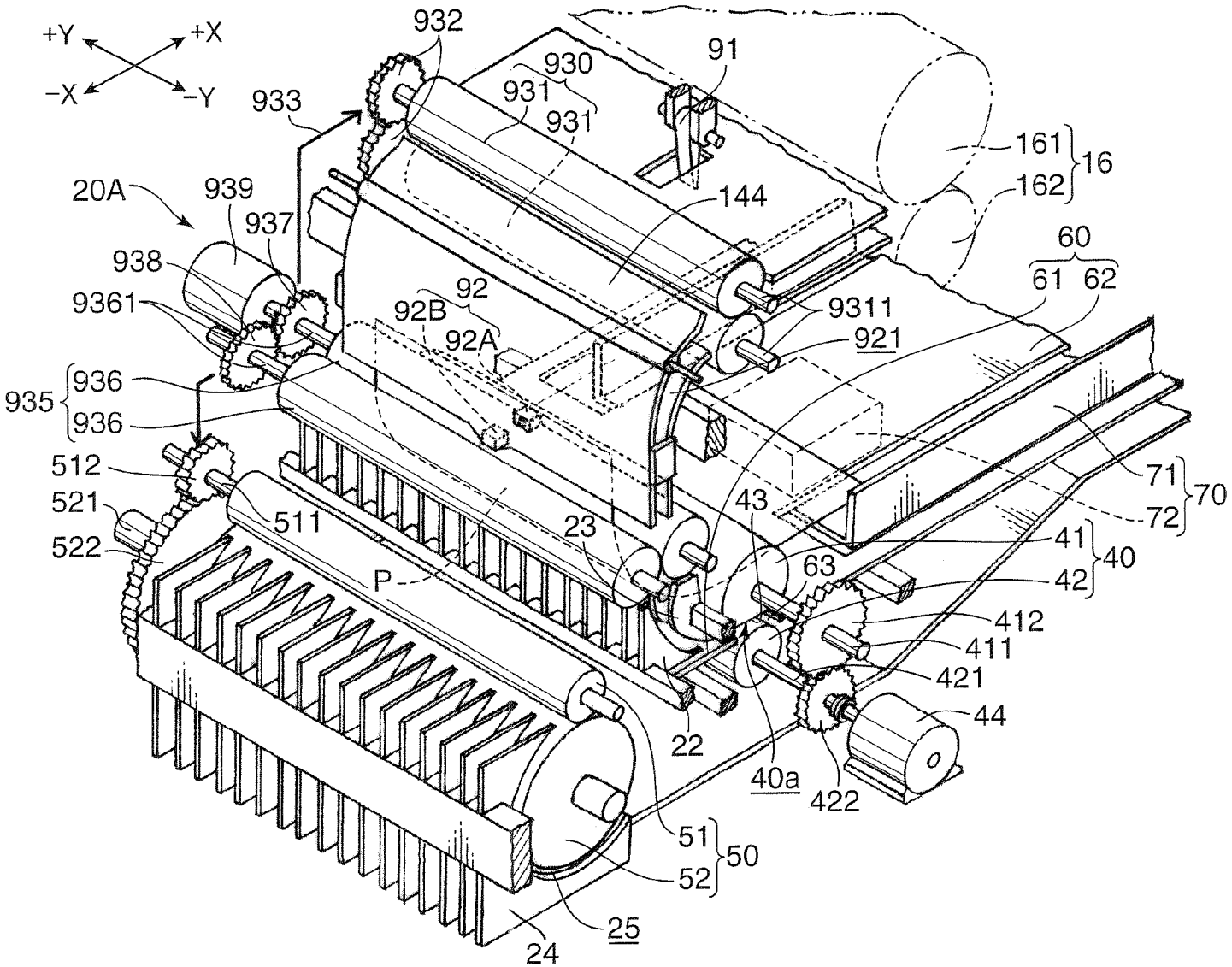
FIG. 6 is a perspective view showing a conveying section for a double-sided copying in accordance with a second embodiment.
Figure 7:
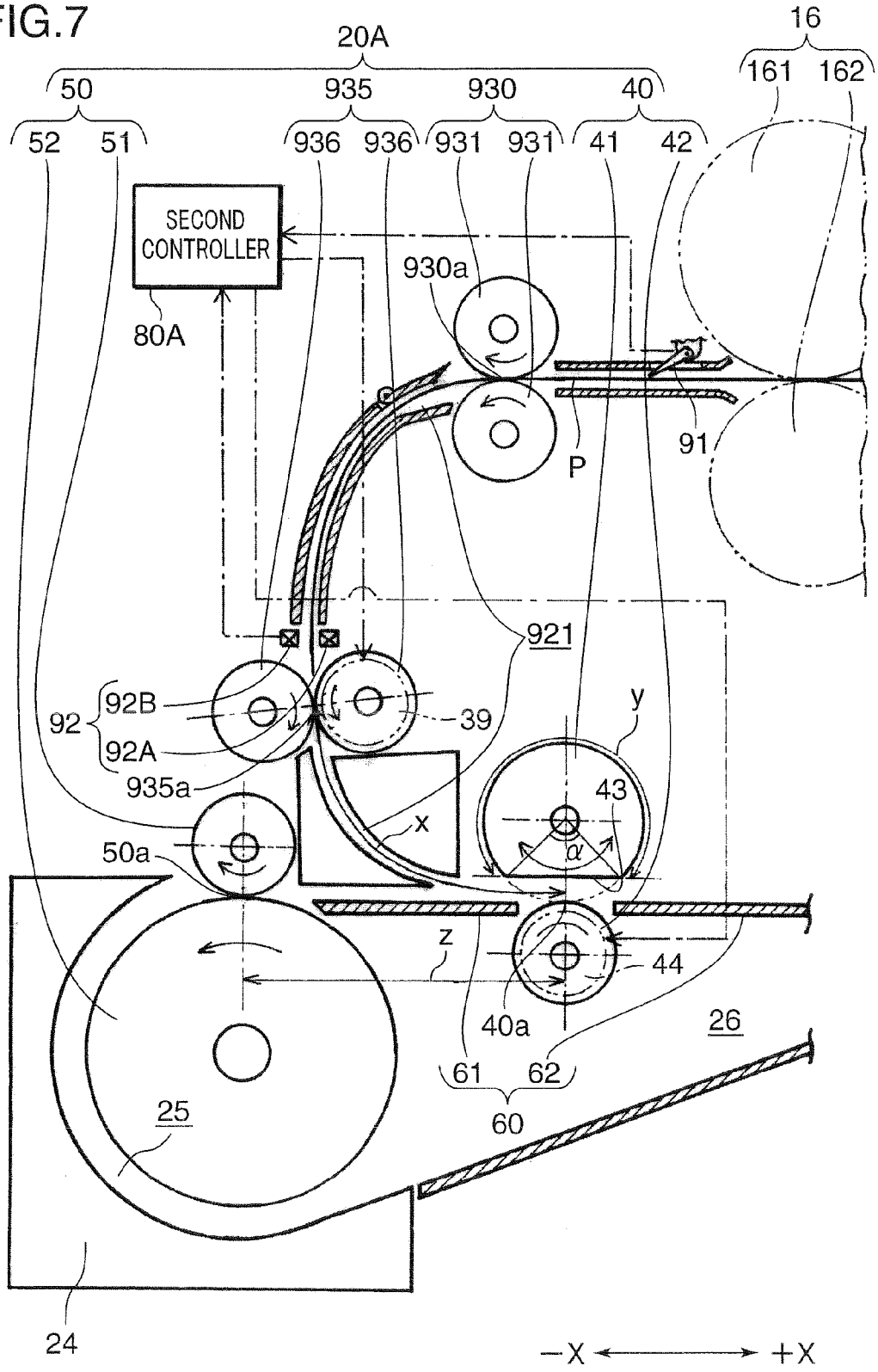
FIG. 7 shows a front view of the conveying section for a double-sided copying shown in FIG. 6.

FIG. 6 is a perspective view showing a conveying section 20A for the double-sided copying in accordance with a second embodiment. FIG. 7 shows a front view of FIG. 6. It should be noted that, in FIGS. 6 and 7, the direction of X–X corresponds to leftward and rightward directions, and the direction of Y–Y corresponds to frontward and rearward directions. Specifically, the direction of –X corresponds to the leftward direction, the direction of +X corresponds to the rightward direction, the direction of –Y corresponds to the frontward direction, and the direction of +Y corresponds to the rearward direction. In these drawings, the parts which are the same as those of FIGS. 2 and 3 are identified by the same reference numerals, and description regarding those same parts will be omitted or simplified.

As shown in FIG. 6, the conveying section 20A for the double-sided copying includes a pair of first branch rollers 930 (fourth pair of rollers) provided on an immediate downstream side of the fixing device 16, a pair of second branch rollers 935 (first pair of rollers in the present embodiment) provided on an immediate downstream side of the pair of first branch rollers 930 in the branch conveying passage 921, a pair of reversing rollers 40 (second pair of rollers) provided on a lower right side of the pair of second branch rollers 935, a pair of sheet re-feeding rollers 50 (third pair of rollers) provided on a left side of the pair of reversing rollers 40 and immediately under the pair of second branch rollers 935, a sheet reversing tray 60 (reversing section) extending rightward from the sheet re-feeding nip portion 50*a* of the pair of sheet re-feeding rollers 50 through the reversing nip portion 40*a* of the pair of reversing rollers 40, and a lateral position adjusting mechanism 70 provided on a right side of the sheet reversing tray 60 from the reversing nip portion 40*a* for adjusting a conveyance posture of the sheet P.

A distance between the fixing device 16 and the pair of first branch rollers 930 is so set as to be smaller than a length in a conveying direction of the sheet P having the smallest size among the sheets P of various sizes which are to be subjected to the processing in the image forming apparatus 10. This makes a conveyance loss of the sheets to be as small as possible.

The pair of first branch rollers 930 includes a pair of upper and lower first branch rollers 931 (seventh and eighth unit rollers) extending frontward and rearward direction. The first branch rollers 931 are supported axially and integrally rotatably about first branch roller shafts 9311, respectively, extending coaxially in the frontward and rearward directions. Over respective rear end portions of the first branch rollers shafts 9311, gears 932 which are in mesh with each other are fitted integrally rotatably. The pair of gears 932 which are in mesh with each other cause the first branch rollers 931 to integrally rotate about the respective first branch roller shafts 9311 toward the directions opposite to each other.

The pair of second branch rollers 935 include a pair of second branch rollers 936 extending in the frontward and rearward directions and arranged side by side. The second branch rollers 936 are supported integrally rotatably about respective second branch roller shafts 9361 extending coaxially in the frontward and rearward directions. Over one of the pair of second branch roller shafts 9361 (the one on the right hand side in the example shown in FIG. 6), a drive gear 937 is fitted coaxially and integrally rotatably. Over the other one, a driven gear 938 is fitted coaxially and integrally rotatably. The drive gear 937 and the driven gear 938 are in mesh with each other.

To the second branch roller shaft 9361 provided with the drive gear 937, a driving shaft of the conveying motor 939 is connected coaxially and integrally rotatably. Thus, if the conveying motor 939 is driven, a drive force is transmitted sequentially to the second branch roller shaft 9361 on the right side, the drive gear 937 integrally provided to the second branch roller shaft 9361, and the driven gear 938. Accordingly, the pair of second branch rollers 936 are rotated in opposite directions.

As the conveying motor 939, a stepping motor is adopted which may control the number of rotations with an extreme precision. A drive force of the conveying motor 939 is transmitted to the pair of first branch rollers 930 through a first group of gears 933 provided between the drive gear 937 and the gear 932 of the pair of first branch rollers 931. Thus, when the conveying motor 939 is driven, both the pair of first branch rollers 930 and the pair of second branch rollers 935 are rotated concurrently. Accordingly, the sheet P which arrives at the nip portion (first branch nip portion 930*a*; fourth nip portion) of the pair of first branch rollers 930 from the fixing device 16 is conveyed by the rotation of each of the first branch rollers 931 to the nip portion (second branch nip portion 935*a*; first nip portion) of the pair of second branch rollers 936 through the branch conveying passage 921.

The pair of reversing rollers 40 have a configuration which is the same as that of the first embodiment, and it includes an upper reversing roller 41 having a chord surface 43 and a lower reversing roller 42 so arranged as to oppose to the upper reversing roller 41 on a lower side to form a reversing nip portion 40*a*. Also, it is the same as the first embodiment in that the pair of sheet re-feeding rollers 50 includes an upper sheet re-feeding roller 51 having a small diameter and a lower sheet re-feeding roller 52 having a large diameter to form a sheet re-feeding nip portion 50*a*. Further, the sheet reversing tray 60 and the lateral position adjusting mechanism 70 are also the same.

In the conveying section 20A for the double-sided copying so configured as described above, as shown in FIG. 7, a first distance x of an arc-shaped passage between the second branch nip portion 935*a* and the reversing nip portion 40*a* is so set as to be greater than an arc length y of the upper reversing roller 41 ($x>y$). Thus, by rotating the upper reversing roller 41, whose chord surface 43 facing downward, by one rotation in the counter-clockwise direction, the sheet P whose rear end gets out of the second branch nip portion 935*a* is conveyed by the driving of the pair of reversing rollers 40 and then is stopped in a state where its rear end has not yet arrive at the reversing nip portion 40*a*. At this time, the upper reversing roller 41 is in the initial passing posture.

A second distance z, which is a distance between the reversing nip portion 40*a* and the sheet re-feeding nip portion 50*a*, is so set as to be greater than the arc length y of the upper reversing roller 41 ($y<z$). Thus, when a new leading end, which was previously the rear end of the sheet P, arrives at the pair of sheet re-feeding rollers 50 by one rotation of the upper reversing roller 41 in the clockwise direction, the sheet P is nipped only by the sheet re-feeding nip portion 50*a*.

The image forming apparatus 10 having such conveying section 20A for the double-sided copying A is provided with a second controller 80A (FIG. 7) including a microcomputer for controlling various operations of the image forming apparatus 10. The second controller 80A is so programmed as to control operations of the conveying section 20A for the double-sided copying. However, it will be described hereinafter a control with respect to the pair of first branch rollers 930 and the pair of second branch rollers 935.

When a rear end of the sheet P conveyed from the fixing device 16 is detected on an immediate downstream side of the fixing device 16, the second controller 80A performs a control of making rotational speeds of the pair of first branch rollers 930 and the pair of second branch rollers 935 be fast to speed up a conveyance speed of the sheet P.

For the purpose of performing such control, there is provided a first sheet rear end sensor 91 (second sensor) on an immediate downstream side of the fixing device 16. In the present embodiment, as the first sheet rear end sensor 91, the one adopting a limit switch type is provided which detects a presence of the sheet P when the sheet P kicks a striker, and on the other hand, detects an absence of the sheet P when the sheet P does not kick the striker. Alternatively, an optical sensor using a light emitting device and a light receiving device may be provided.

When a detection signal about a detection of the rear end of the sheet P (in particular, a signal indicating that a posture of the first sheet rear end sensor 91 is changed from a hanging posture to slanting posture and thereafter put back again to the hanging posture) is inputted from first sheet rear end sensor 91 to the second controller 80A, the second controller 80A outputs a control signal for making a rotational speed of the conveying motor 939 be fast. An increase in a speed of the conveying motor 939 causes a rotation of the pair of second branch rollers 935 to speed up and concurrently increase a speed of rotation of the pair of first branch rollers 930 to which a drive force of the conveying motor 939 is transmitted through the first group of gears 933.

As a result, the sheet P which is conveyed from the fixing device 16 and whose rear end is detected by the first sheet rear end sensor 91 is conveyed in a state of being speeded up, efficiency in processing the sheet is improved. Further, the speeding up of a conveyance of the sheet P is performed after the rear end of the sheet P which is conveyed from the fixing device 16 is detected by the first sheet rear end sensor 91. If the detection of a leading end of the sheet P conveyed from the fixing device 16 is defined as a starting point, and thereafter a conveyance speed of the sheet P is speeded up after elapse of a predetermined time from the starting point, conveyance of the sheet P is speeded up even though the sheet P is not yet completely conveyed from the nip portion of the fixing device 16, so that an inappropriate force is disadvantageously applied to the sheet P. However, according to the present embodiment, occurrence of such disadvantage may be prevented.

Such speeding up of the sheet P is continued until the rear end of the sheet P is detected by a second sheet rear end sensor 92 provided on an immediate upstream side of the pair of second branch rollers 935. Such control is performed since, in the present embodiment, rotation of the pair of reversing rollers 40 is controlled while the point of time at which the rear end of the sheet P is detected by the second sheet rear end sensor 92 (which corresponds to the sheet rear end sensor 81 according to the first embodiment) is defined as a starting point, and it is likely that continuing such high-speed conveyance of the sheet P may cause an over-running to disturb an accurate control of the pair of reversing rollers 40.

When the second sheet rear end sensor 92 detects the rear end of the sheet P, a detection signal is inputted to the second controller 80A. The second controller 80A outputs a control signal in accordance with the detection signal to control the conveying motor 939 to be in an initial low-speed driving. After that, the sheet P is conveyed to the sheet reversing tray 60 through the pair of reversing rollers 40 in the initial low speed driving.

In the present embodiment, as the second sheet rear end sensor 92, a so-called optical sensor is adopted which is provided with a light emitting section 92A having a light emitting device, and a light receiver 92B having a light receiving device which receives a light from the light emitting section 92A. Such light emitting section 92A and light receiver 92B are so arranged as to oppose to each other at an immediate upper side of the second branch nip portion 935*a* over the branch conveying passage 921.

When the sheet P passes through the light emitting section 92A and the light receiver 92B, irradiation of light from the light emitting section 92A to the light receiver 92B is temporarily interrupted. When the rear end of the sheet P passes through those, the light irradiated from the light emitting section 92A is received by the light receiver 92B again. The received light signal is inputted as a detection signal to the second controller 80A.

The second controller 80A stores a time (adjustment time) which is calculated in accordance with a conveyance speed of the sheet P and taken between the detection of the rear end of the sheet P by the second sheet rear end sensor 92 and the arrival of the rear end to the second branch nip portion 935*a*. Then, after elapse of the adjustment time, the second controller 80A gives a control signal for rotating the upper reversing roller 41 by one rotation in the counter-clockwise direction in FIG. 7 to the motor 44 for the reversing rollers (FIG. 6).

After receiving the control signal from the second controller 80A, the motor 44 for the reversing rollers drives the upper reversing roller 41 to rotate in the counter-clockwise direction (the lower reversing roller 42 rotates in the clockwise direction) by one rotation. Therefore, the sheet P is conveyed toward the right sheet reversing tray 62 by only the arc length y of the upper reversing roller 41. Then, after the chord surface 43 falls in a state of opposing to the lower reversing roller 42, a processing of correcting the oblique passing of the sheet P is performed by the lateral position adjusting mechanism 70.

After that, in accordance with a control signal transmitted from the second controller 80A, the upper reversing roller 41 is rotated in the clockwise direction in FIG. 7 (the lower reversing roller 42 is rotated in the counter-clockwise direction) by one rotation. Accordingly, the sheet P is pulled out from the right sheet reversing tray 62 to the sheet re-feeding nip portion 50*a* of the pair of sheet re-feeding rollers 50. Then, in a state where a posture of the upper reversing roller 41 is so set as to be in the passing posture (in other words, the chord surface 43 of the upper reversing roller 41 becomes horizontal), since the second distance z is so set as to be greater than the arc length y of the upper reversing roller 41, the sheet P is nipped at its leading end by the sheet re-feeding nip portion 50*a* of the pair of sheet re-feeding rollers 50. After that, the sheet P is put back to the image forming section 11 through the semicircular conveying passage 25 and the reversing conveying passage 26.

Hereinafter, an operation of the conveying section 20A for the double-sided copying—will be described with reference to FIGS. 8-10C, and FIGS. 6 and 7 as needed.

Figure 8:
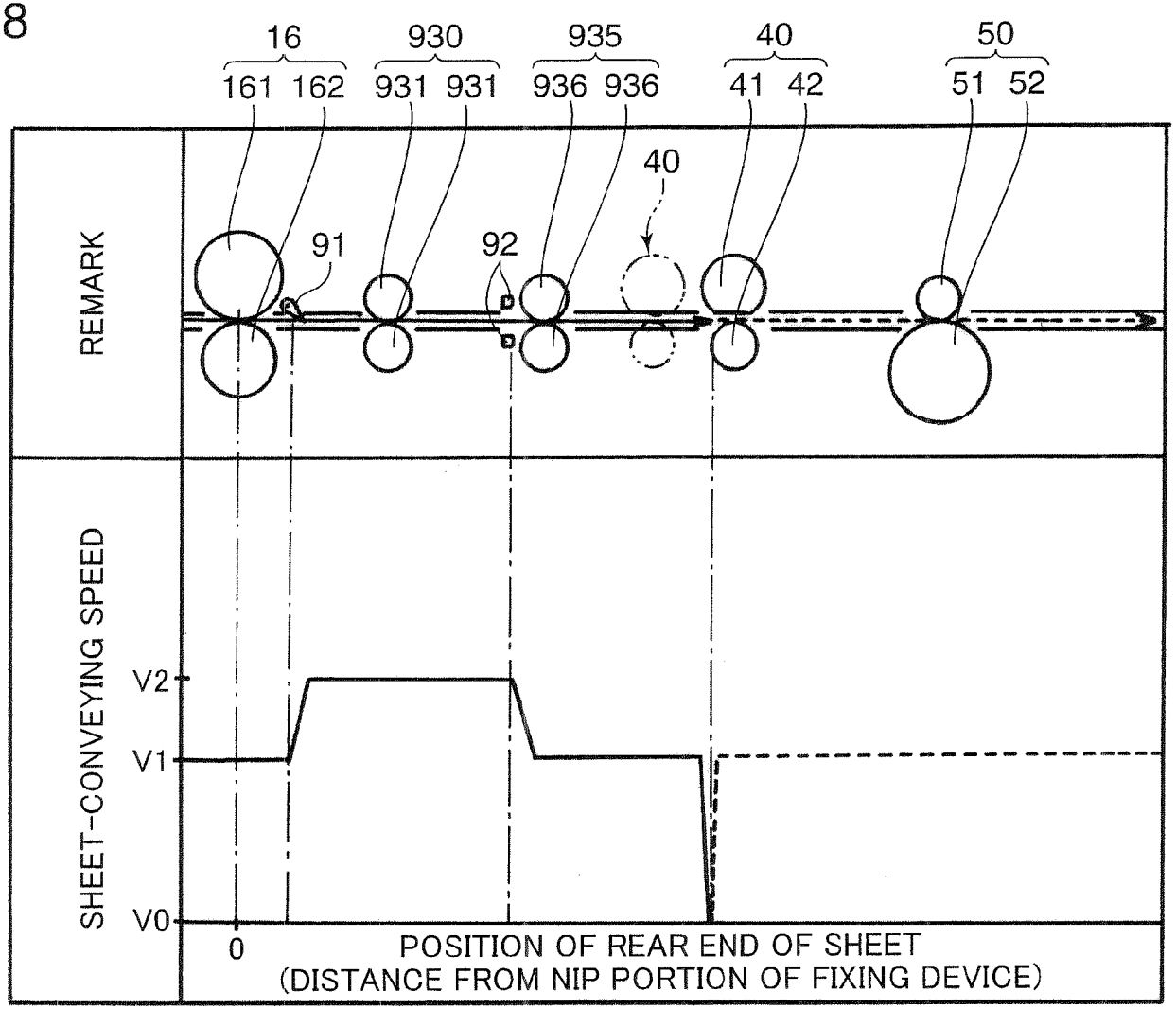
FIG. 8 is a graph showing a relation between positions of a rear end a sheet to which one-side printing is performed and a sheet conveying speed.

FIG. 8 is a graph showing a relation between a rear end position of the sheet P, to which the one-side printing is performed, and a conveyance speed. The horizontal axis indicates a distance starting from the nip portion of the fixing device 16, and the vertical axis indicates a conveyance speed of the sheet P. In the remarks space of FIG. 8, the fixing device 16, the first sheet rear end sensor 91, the pair of first branch rollers 930, the second sheet rear end sensor 92, the pair of second branch rollers 935, the pair of reversing rollers 40, and the pair of sheet re-feeding rollers 50 are shown in a straight line, so that it is made easy to visually understand a relation between the position of the rear end of the sheet P and the conveyance speed. Actual conveyance direction of the sheet P is different as shown in FIG. 7. However, FIG. 8 mainly focus on a distance from a starting point taking in consideration that the sheet P is conveyed only in leftward direction in the sheet of FIG. 8 without changing in the direction.

The sheet P is conveyed at a first speed V1 suitable for the image forming processing performed in the image forming section 11 and goes out of the nip portion of the fixing device 16. When the rear end of the sheet P goes out of the fixing nip portion and is detected by the first sheet rear end sensor 91, the number of rotations of the pair of first branch rollers 930 increases in accordance with a control signal transmitted from the second controller 80A. Accordingly, the conveyance speed of the sheet P is speeded up from the first speed V1 to a second speed V2 which is high-speed.

Next, when the rear end of the sheet P goes beyond the pair of first branch rollers 930 and is detected by the second sheet rear end sensor 92 provided immediately before the pair of second branch rollers 935, the conveyance speed of the sheet P is reduced from the second speed V2 to the first speed V1. When the rear end of the sheet passes through the pair of second branch rollers 935 by the driving of the pair of second branch rollers 935 rotating at a rotational speed corresponding to the first speed V1 in this state, a drive force of the pair of second branch rollers 935 does not reach the sheet P.

Next, the second controller 80A drives the pair of reversing rollers 40 so that the upper reversing roller 41 rotates by one rotation. After that, the pair of reversing rollers 40 are stopped temporarily. This causes the conveyance speed V0 of the sheet P to be "0". Then, the pair of reversing rollers 40 are rotated by one rotation toward opposite directions. Accordingly, the sheet P is conveyed reversely, pulled out from the sheet reversing tray 60, and then reversed front and back. In the remark section of FIG. 8, the pair of reversing rollers 40 which are reversely rotated are indicated by imaginary lines, so that it is expressed that the sheet P is switched back. In FIG. 8, a path of the rear end of the sheet P which is switched back is indicated by a dot line.

Next, the sheet P is conveyed by the driving of the pair of sheet re-feeding rollers 50 from the conveying section 20A for the double-sided copying toward the image forming section 11 again in a state where front and back sides are reversed, and then a printing processing is performed with respect to the back side.

As described above, the sheet conveyed from the fixing device 16 at the first speed V1, when its rear end moves from the position of the first sheet rear end sensor 91 on an immediate downstream side of the fixing device 16 to the second sheet rear end sensor 92 on an immediate upstream side of the pair of second branch rollers 935, the conveyance speed becomes the second speed V2 which is faster than the first speed V1. Therefore, a time taken for putting back the sheet P, to which a one-side printing processing is completed, to the image forming section 11 is shortened, so that efficiency in processing the sheet P at the time of the double-sided printing can be improved.

Further, since the control of the conveyance speed of the sheet P is performed in accordance with the detection of the rear end of the sheet P by the first sheet rear end sensor 91, it can prevent a disadvantage which occurs in the case where the detection is performed with respect to the leading end of the sheet, in other words, a disadvantage that the pair of first branch rollers 930 pulls the sheet P at high speed even though the sheet P conveyed at low-speed is not completely pulled out of the fixing device 16.

Figure 9A:
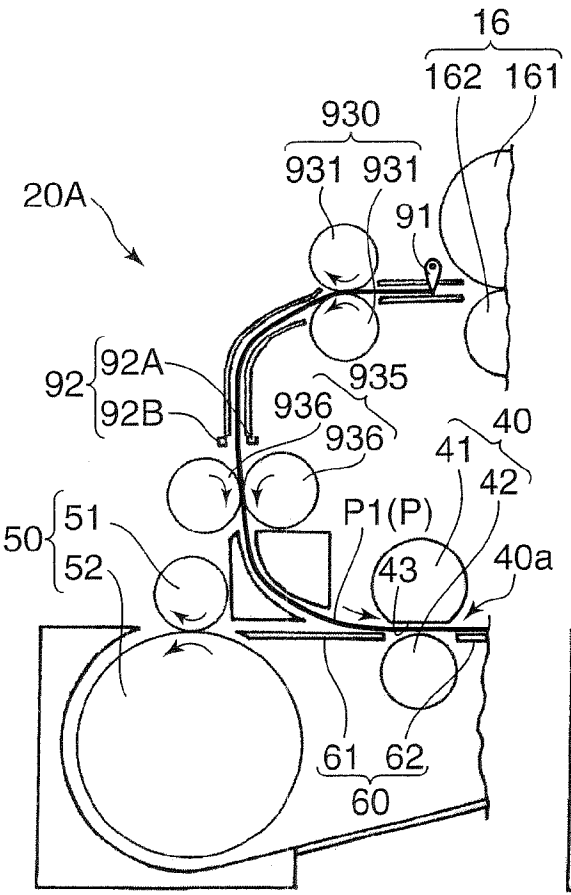
FIGS. 9A-9C show an operation of the conveying section for a double-sided copying in accordance with the second embodiment.
Figure 9B:
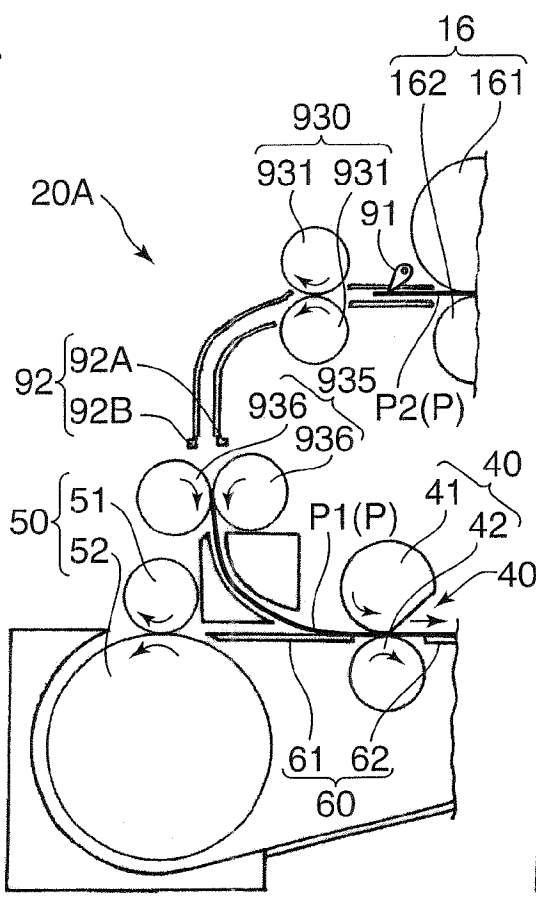
Figure 9C:
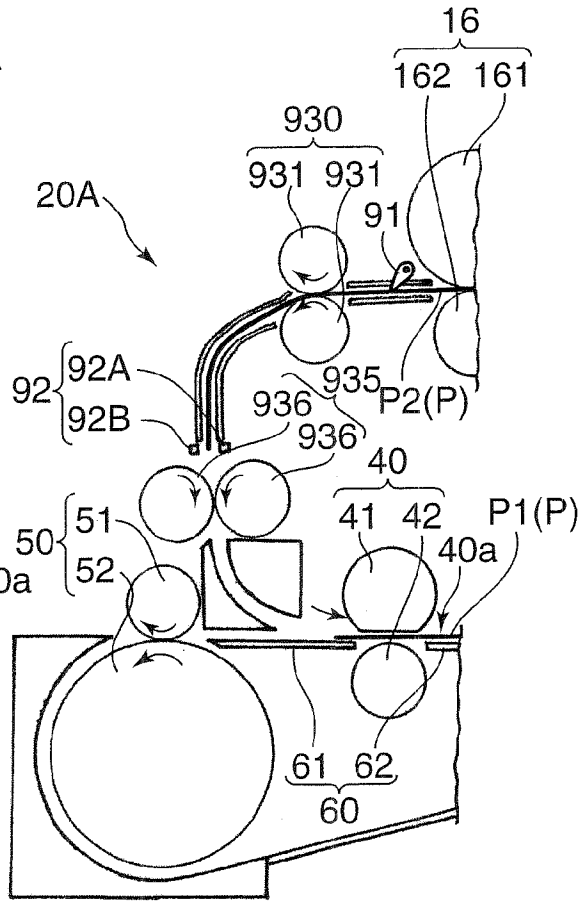

Next, an operation of conveying two sheets P in the conveying section 20A for the double-sided copying while allowing the sheets P be present concurrently in the sheet reversing tray 60 will be described with reference to FIGS.9A-10C. FIG. 9A shows a state where the pair of second branch rollers 935 pass the sheet P through a clearance between the pair of reversing rollers 40 and the leading end of the sheet P starts to enter the right sheet reversing tray 62. FIG. 9B shows a state where the rear end of the sheet P is detected so that the upper reversing roller 41 starts to rotate in the counter-clockwise direction. FIG. 9C shows a state where the upper reversing roller 41 rotates by one rotation so that the sheet P is temporarily conveyed to the right sheet reversing tray 62.

Figure 10A:
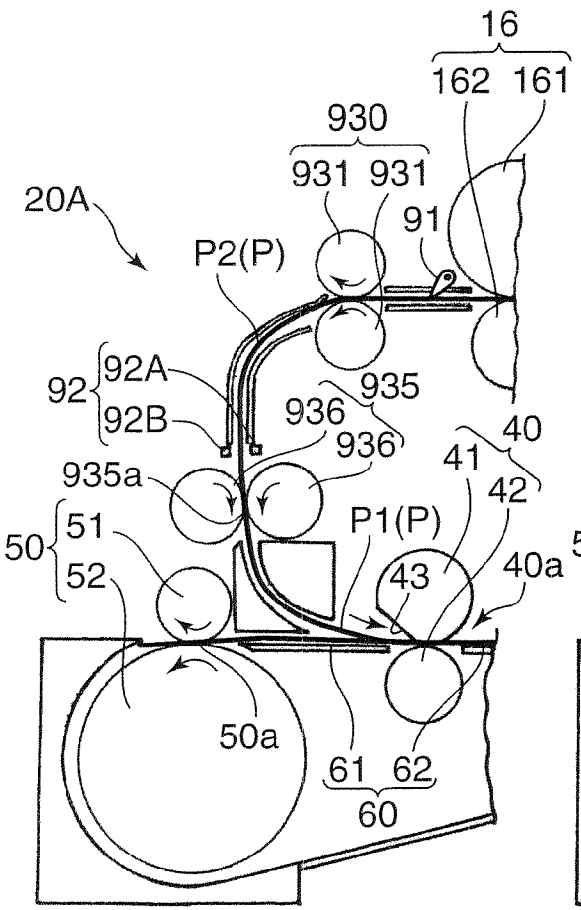
FIGS. 10A-10C show an operation of the conveying section for a double-sided copying in accordance with the second embodiment.
Figure 10B:
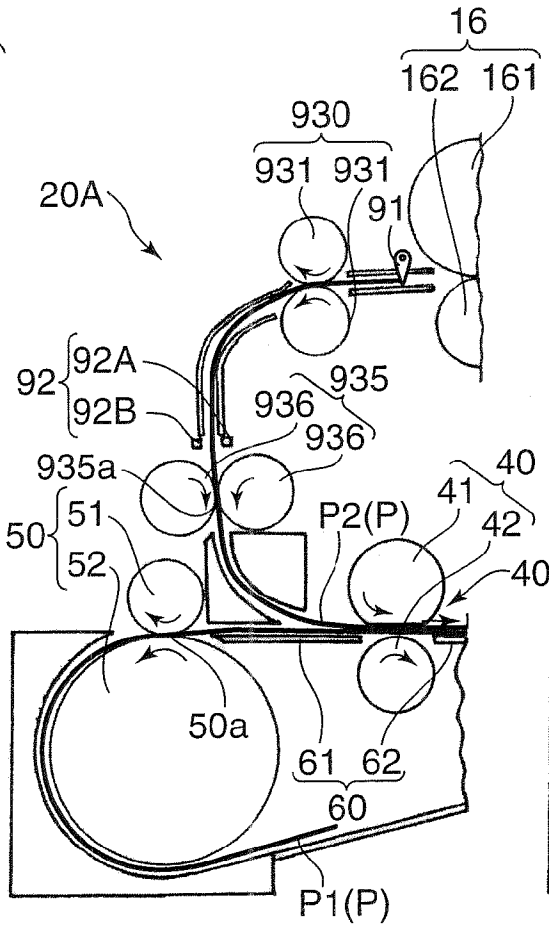
Figure 10C:
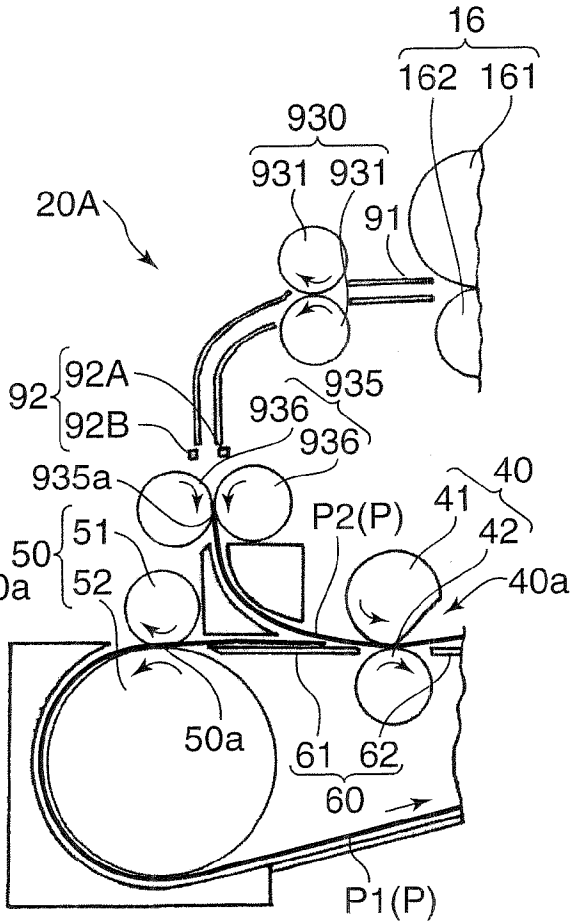

FIG. 10A shows a state where the upper reversing roller 41 starts to rotate in the clockwise direction. FIG. 10B shows a state where the upper reversing roller 41 is rotated by one rotation in the clockwise direction and the next sheet P enters the right sheet reversing tray 62 through the pair of reversing rollers 40. FIG. 10C shows a state where the previous leading end (a new rear end) of the first sheet P arrives at the sheet re-feeding nip portion 50*a*, and the leading end of the next sheet P arrives at the second branch nip portion 935*a*.

FIG. 9A shows a state where the sheet P, which is a first page of print job and on which an image is formed on a front side, is sent to the right sheet reversing tray 62 by the rotation of the pair of second branch rollers 935. The rear end of the sheet P passes through the first sheet rear end sensor 91. Therefore, as described above, after the state shown in FIG. 9A, the rotational speeds of the pair of first branch rollers 930 and the pair of second branch rollers 935 are increased, so that the sheet P is conveyed at a high-speed.

At this time, the chord surface 43 of the upper reversing roller 41 faces downward so as to oppose to the peripheral surface of the lower reversing roller 42, so that the pair of reversing rollers 40 are in a state of allowing the sheet P to pass through. Thus, the sheet P is conveyed toward the right sheet reversing tray 62 only by the driving of the pair of second branch rollers 935 without rotation of the pair of reversing rollers 40.

Next, when the second sheet rear end sensor 92 detects the rear end of the sheet P, the second controller 80A sets the rotational speeds of the pair of first branch rollers 930 and the pair of second branch rollers 935 to the normal speed. Further, the second controller 80A transmits a drive signal for normally driving (rotation in the counter-clockwise direction) the reversing roller 41 to the motor 44 for the reversing rollers at a predetermined delayed time. Accordingly, as shown in FIG. 9B, the upper reversing roller 41 starts to rotate toward the counter-clockwise direction. After that, the sheet P is released from a force of the pair of second branch rollers 935 and conveyed toward the right sheet reversing tray 62 by a force of the pair of reversing rollers 40.

When the upper reversing roller 41 rotates about an upper roller shaft 411 in the counter-clockwise direction by one rotation, the upper reversing roller 41 is stopped in accordance with a control signal transmitted from the second controller 80A, as shown in FIG. 9C. Accordingly, the sheet P moves by the arc length y of the upper reversing roller 41 from the state shown in FIG. 9B, but the rear end of the sheet P does not get out of the reversing nip portion 40*a* since the mathematic relation of $x>y$ is set.

Next, as shown in FIG. 10A, the upper reversing roller 41 is rotated in the clockwise direction. At this time, the lower reversing roller 42 is rotated in the counter-clockwise direction. At the same time, the pair of sheet re-feeding rollers 50 are also rotated. Accordingly, the sheet P is reversely conveyed to be pulled out of the right sheet reversing tray 62, and moves straightly toward the sheet re-feeding nip portion 50*a*.

As shown in FIG. 10B, the pair of reversing rollers 40 are stopped when the upper reversing roller 41 is rotated by one rotation and put back to be the passing posture. After that, the sheet P gets out of the force of the pair of reversing rollers 40 and then is conveyed only by a force of the pair of sheet re-feeding rollers 50.

As shown in FIG. 10B, at a timing when the leading end (previously the rear end) of the sheet P which is reversely conveyed arrives at the sheet re-feeding nip portion 50*a*, the second sheet P is supplied by the pair of second branch rollers 935 toward the pair of reversing rollers 40. Accordingly, even though the first sheet P is not completely pulled out of the right sheet reversing tray 62, the second sheet P is conveyed toward the right sheet reversing tray 62.

At this time, the upper reversing roller 41 is so set as to be in the passing posture in which the chord surface 43 is oriented downward, so that the clearance 63 is formed between the chord surface 43 and the peripheral surface of the lower reversing roller 42. Accordingly, the second sheet P is conveyed to the right sheet reversing tray 62 while slipping on the upper surface of the first sheet P and passing through the clearance 63. This situation is the same as that shown in FIG. 9A if the second sheet P is identified as the first sheet P.

Next, when the rear end of the second sheet P arrives at the second branch nip portion 935*a*, as shown in FIG. 10C, the upper reversing roller 41 starts the normal rotation. Accordingly, after that, the sheet P is conveyed by driving of the pair of reversing rollers 40. This situation is the same as that shown in FIG. 9B. At this time, the first sheet P is being conveyed toward the reversing conveying passage 26 (FIG. 7) through the semicircular conveying passage 25, and the upstream end arrives at the sheet re-feeding nip portion 50*a*.

After that, the third and subsequent sheets P are sequentially supplied to the conveying section 20A for the double-sided copying. Accordingly, the operations of the pair of second branch rollers 935, the pair of reversing rollers 40, and the pair of sheet re-feeding rollers 50 are repeated, so that the double-sided printing processing with respect to the sheet P by using the conveying section 20A for the double-sided copying can be executed efficiently.

As described above in detail, the conveying section 20A for the double-sided copying in accordance with the second embodiment includes the pair of first branch rollers 930 and the pair of second branch rollers 935 for conveying the sheet P, to which the fixing processing is performed in the fixing device 16, toward the sheet reversing tray 60 to branch out and reverse front and back, the pair of reversing rollers 40 for conveying the sheet P, which is caused to head toward the sheet reversing tray 60, to the sheet reversing tray 60 by normal rotation and taking out the sheet P temporarily conveyed to the sheet reversing tray 60 by reverse rotation, the pair of sheet re-feeding rollers 50 for putting the sheet P back to the image forming section 11 through the reversing conveying passage 26 so that the image forming processing is applied to the back side of the sheet P taken out from the sheet reversing tray 60, the first sheet rear end sensor 91 for detecting whether the sheet P is discharged from the fixing device 16, and the second controller 80A for controlling the pair of first branch rollers 930 and the pair of second branch rollers 935 to increase their respective rotational speeds when the first sheet rear end sensor 91 detects the rear end of the sheet P.

According to this configuration, in addition to the advantages described above in the first embodiment, the sheet P discharged from the fixing device 16 in a state where the printing processing with respect to one side is completed is conveyed to the sheet reversing tray 60 in a state of being speeded up by increase in rotational speeds of the pair of first branch rollers 930 and the pair of second branch rollers 935 after the first sheet rear end sensor 91 detects that the sheet P is discharged from the fixing device 16. As described above, since the sheet P is conveyed in a state of being speeded up, efficiency in processing the sheet at the time of the double-sided printing processing can be improved.

Further, after the rear end of the sheet P is detected by the first sheet rear end sensor 91, rotations of the pair of first branch rollers 930 are speeded up. Therefore, a pulling tensional force toward the conveying direction is not exerted to the sheet P due to the speeding up of the pair of first branch rollers 930 if the sheet P is not completely derived from the fixing device 16. Thus, occurrence of a defective image in which a fixed image is dislocated, or breaking of the sheet P can be prevented.

The second embodiment of the present invention is described above. However, the second embodiment may take the following modifications.

(1) In the embodiment described above, the pair of first branch rollers 930 and the pair of second branch rollers 935 are driven by one conveying motor 939. Alternatively, drive motors exclusively for respective rollers may be used.

(2) In the embodiment described above, it is so set that the sheet P taken out of the sheet reversing tray 60 by reverse rotation of the pair of reversing rollers 40 is conveyed at the first speed V1 which is low-speed, as shown in FIG. 8. Alternatively, it may be so set as to be the second speed V2 which is high-speed. Accordingly, that a time taken for putting the sheet P whose front and back sides are temporarily reversed back to the image forming section 11 through the reversing conveying passage 26 can be shortened drastically, so that ability to process the sheet P can be improved drastically.

(3) In the embodiment described above, an example is shown in which the second sheet rear end sensor 92 is provided on an immediate upstream side of the pair of second branch rollers 935. Not limited to this, the second sheet rear end sensor 92 may be provided on an immediate down stream side of the pair of second branch rollers 935. In a case where the second sheet rear end sensor 92 is provided on an immediate downstream side of the pair of second branch rollers 935, it is necessary to calculate a time between detection of the rear end of the sheet P by the second sheet rear end sensor 92 and releasing of the rear end from the second branch nip portion 935*a* and perform a control of driving the pair of reversing rollers 40 after elapse of the calculated time. However, in the case where the second sheet rear end sensor 92 is provided on an immediate downstream side of the pair of second branch rollers 935, the pair of reversing rollers 40 can be driven concurrently with the detection of the rear end of the sheet P by the second sheet rear end sensor 92. Accordingly, wasteful time calculation can be omitted, so that it is advantageous in simplifying a drive control of the pair of reversing rollers 40.

The embodiments described above mainly includes the invention having the following configurations.

An image forming apparatus in accordance with an aspect of the present invention includes: an image forming section for transferring a toner image onto a sheet; a fixing section for fixing the toner image transferred onto the sheet; a reversing section for reversing the sheet front and back; a first pair of rollers including a pair of first and second unit rollers forming a first nip portion for causing the sheet, which bears the toner image transferred onto a front side in the image forming section and fixed in the fixing section, to be transferred to the reversing section; a second pair of rollers including third and fourth unit rollers forming a second nip portion, the third unit roller having on its outer peripheral surface an arc-shaped surface and a non-arc-shaped surface receding inwardly from a circle drawn continuously from the arc-shaped surface, the third unit roller adapted for feeding the sheet, which is caused to be transferred to the first pair of rollers, to the reversing section by normal rotation and pulls out the sheet, which is temporarily transferred to the reversing section, from the reversing section by reverse rotation; and a third pair of rollers including fifth and sixth unit rollers forming a third nip portion, the third pair of rollers transferring the sheet to a predetermined conveying passage, which is adapted for putting the sheet back to the image forming section, so that an image forming is performed with respect to the back side of the sheet pulled out by the second pair of rollers from the reversing section.

According to this configuration, the sheet temporarily conveyed to the reversing section by the first pair of rollers and the second pair of rollers which are normally rotated is taken out from the reversing section in a state of being reversed front and back by reverse rotation of the second pair of rollers, nipped by the third pair of rollers, and then put back to the image forming section through the reversing conveying passage by driving of the third pair of rollers. The second pair of rollers are not separated by driving of a solenoid, unlike the conventional manner. The non-arc-shaped surface is formed in the third unit roller, so that the nip with respect to the sheet may be eliminated. Therefore, nipping and releasing of the nip with respect to the sheet moving toward the reversing section can be realized only by the rotational state of the second pair of rollers. Accordingly, as compared to the method of using a solenoid, it is not necessary to increase the number of parts, so that it can contribute to a reduction of an apparatus cost. Further, a delay in response of a solenoid can be also eliminated.

In the configuration described above, it is preferable that the non-arc-shaped surface includes a chord surface which is parallel to an axial direction of the third unit roller. According to this configuration, at a time of releasing the nip, a space which is capable of easily guiding the sheet can be defined between the third unit roller and the fourth unit roller.

In the configuration described above, it is preferable that the following mathematical relation is met:

$$x>y<z$$

where x=a distance between the first nip portion and the second nip portion, y=an arc length of the third unit roller, and z=a distance between the second nip portion and the third nip portion.

According to this configuration, by setting the mathematical relation of $x>y$, a rear end of the sheet is positioned on an upstream side of the nip portion of the second pair of rollers at a time when the third and fourth unit rollers are rotated by one rotation. Thus, at a time of subsequently performed reverse rotation of the second pair of rollers, the sheet can be nipped assuredly. Further, by setting the mathematical relation of $y<z$, the sheet is prevented from being nipped concurrently by the nip portion of the second pair of rollers and the nip portion of the third pair of rollers, so that occurrence of wrinkles and damage in the sheet can be prevented.

In the configuration described above, it is preferable that the image forming apparatus further includes: a first sensor for detecting whether a rear end of a sheet passes through the first nip portion; and a first controller for causing normal rotation of the second pair of rollers in accordance with a detection result of the first sensor.

According to this configuration, the second pair of rollers are normally rotated at a timing when it is detected that the rear end of the sheet passes through the nip portion of the first pair of rollers, so that the sheet is conveyed by the second pair of rollers to the reversing section.

It is preferable that the arc-shaped surface of the third unit roller has such a diameter which causes the sheet to be conveyed by one rotation of the third unit roller to a position where the rear end of the sheet is positioned on an immediate upstream side of the second nip portion when the first sensor detects the rear end of the sheet.

According to this configuration, only one rotation of the third unit roller causes the rear end of the sheet to be positioned on an immediate upstream side of the nip portion of the second pair of rollers. Therefore, as compared to the case where the rear end of the sheet is positioned on an immediate upstream side of the nip portion of the second pair of rollers by less than one rotation or a plurality of rotations, a structure for conveying the sheet and a conveyance can be simplified.

In the configuration described above, it is preferable that the image forming apparatus further includes: an adjusting mechanism for adjusting a lateral position of the sheet conveyed to the reversing section. According to this configuration, the lateral position adjusting mechanism adjusts an oblique passing of the sheet.

In the configuration described above, it is preferable that the image forming apparatus further includes: a second sensor for detecting whether the sheet is discharged from the fixing section; and a second controller for controlling a rotational speed of the first pair of rollers to be higher in accordance with a detection signal detected by the second sensor.

According to this configuration, after the second sensor detects that the sheet is discharged from the fixing section, the sheet can be conveyed to the reversing section in a state of being speeded up due to an increase in the rotational speed of the first pair of rollers. Thus, efficiency in processing the sheet at a time of double-sided printing can be improved by amount of increase in the speed.

In this case, it is preferable that the image forming apparatus further includes: a fourth pair of rollers including a pair of seventh and eighth unit rollers forming a fourth nip portion, the fourth pair of rollers being provided between the fixing section and the first pair of rollers, and the second controller controls a rotational speed of the first pair of rollers and the fourth pair of rollers to be higher in accordance with a detection signal detected by the second sensor. According to this configuration, adding the fourth pair of rollers causes the sheet to be conveyed in high-speed in a more stable manner.

Further, it is preferable that a distance between the fixing section and the fourth nip portion is so set as to be shorter a length in a conveying direction of the sheet having a smallest size which can be processed in the image forming apparatus. According to this configuration, the distance between the fixing section and the fourth pair of rollers is set so as to be as small as possible, so that a loss in time of conveying the sheet becomes small.

It is preferable that the second sensor detects a rear end of a sheet. According to this configuration, as compared to the method of determining whether or not the sheet is completely derived from the fixing section based on elapse of time set for each size after a rear end of the sheet is detected, detection can be performed in easier and more assured manner.

In the configuration described above, it is preferable that the image forming apparatus further includes a stepping motor for driving the first pair of rollers. Since the stepping motor can control the rotational speed accurately, it is suitable for controlling rotational speed of the first pair of rollers, which should be performed accurately.

An image forming apparatus in accordance with another aspect of the present invention includes: an image forming section for transferring a toner image onto a sheet; a fixing section for fixing the toner image transferred onto the sheet; a reversing section for reversing the sheet front and back; a first pair of rollers for causing the sheet, which bears the toner image transferred onto a front side in the image forming section and fixed in the fixing section, to be transferred to the reversing section; a second pair of rollers for feeding the sheet, which is caused to be transferred to the first pair of rollers, to the reversing section by normal rotation and pulls out the sheet, which is temporarily transferred to the reversing section, from the reversing section by reverse rotation; a third pair of rollers for transferring the sheet to a predetermined conveying passage, which is adapted for putting the sheet back to the image forming section, so that an image forming is performed with respect to the back side of the sheet pulled out by the second pair of rollers from the reversing section; a second sensor for detecting whether the sheet is discharged from the fixing section; and a second controller for controlling a rotational speed of the first pair of rollers to be higher in accordance with a detection signal detected by the second sensor.

According to this configuration, the rear end of the sheet, which is derived from the fixing section and to which the one-side printing processing is applied, is detected by the second sensor, the first pair of rollers are speeded up. Thus, by the amount of speeding up, efficiency in the sheet processing at the time of the double-sided printing processing can be improved.

This application is based on Japanese Patent application serial No. 2007-196393 filed in Japan Patent Office on Jul. 27, 2007, and Japanese Patent application serial No. 2007-199766 filed on Jul. 31, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming section for transferring a toner image onto a sheet;

a fixing section for fixing the toner image transferred onto the sheet;

a reversing section for reversing facing directions of front and back sides of the sheet that has had the toner image formed on the front side to enable double sided image formation;

a reversing conveying passage formed under the reversing section and disposed for putting the sheet back to the image forming section;

a first pair of rollers provided above the reversing section and including first and second unit rollers forming a first nip portion for feeding toward the reversing section the sheet, which bears the toner image transferred onto a front side in the image forming section and fixed in the fixing section;

a second pair of rollers including third and fourth unit rollers forming a second nip portion, the third unit roller having on its outer peripheral surface an arc-shaped surface and a non-arc-shaped surface receding inwardly from a circle drawn continuously from the arc-shaped surface, the third unit roller adapted for feeding the sheet, which has been fed toward the reversing section by the first pair of rollers, to the reversing section by rotation in a first direction and pulls out the sheet, which is temporarily transferred to the reversing section, from the reversing section by rotation in a second direction opposite to the first direction; and a third pair of rollers including fifth and sixth unit rollers forming a third nip portion, the third pair of rollers transferring the sheet to the reversing conveying passage, so that an image forming is performed with respect to the back side of the sheet pulled out by the second pair of rollers from the reversing section; and a rotational controller for controlling the rotating operation of the third unit roller; wherein the first, second and third pairs of rollers are disposed substantially adjacent to one another along a conveying route along which the sheet is conveyed to the reversing conveying passage via the reversing section;

the following mathematical relation is met:

$$x>y<z$$

where x=a distance between the first nip portion and the second nip portion, y=an arc length of the third unit roller, and z=a distance between the second nip portion and the third nip portion, and the rotational controller causes the third unit roller to start rotating at a time immediately after a rear end of the sheet in a sheet conveying direction is out of the first nip portion, subsequently to stop after one rotation of the third unit roller so that the sheet is stopped in a state where the rear end of the sheet does not arrive at the second nip portion.

2. The image forming apparatus according to claim 1, wherein the non-arc-shaped surface includes a chord surface which is parallel to an axial direction of the third unit roller.

3. The, image forming apparatus according to claim 1, further comprising:

a first nip portion sensor for detecting whether a rear end of a sheet passes through the first nip portion; and a rotational direction controller for causing rotation of the third unit roller in the first direction in accordance with a detection result of the first nip portion sensor.

4. The image forming apparatus according to claim 3, wherein the arc-shaped surface of the third unit roller has such a diameter which causes the sheet to be conveyed by one rotation of the third unit roller to a position where the rear end of the sheet is positioned on an immediate upstream side of the second nip portion when the first nip portion sensor detects the rear end of the sheet.

5. The image forming apparatus according to claim 1, further comprising: an adjusting mechanism for adjusting a lateral position of the sheet conveyed to the reversing section.

6. The image forming apparatus according to claim 1, further comprising:

a fixing section discharge sensor for detecting whether the sheet is discharged from the fixing section; and a rotational speed controller for controlling a rotational speed of the first pair of rollers to be higher in accordance with a detection signal detected by the fixing section discharge sensor.

7. The image forming apparatus according to claim 6, further comprising:

a fourth pair of rollers including seventh and eighth unit rollers forming a fourth nip portion, the fourth pair of rollers being provided between the fixing section and the first pair of rollers, wherein the rotational speed controller controls a rotational speed of the first pair of rollers and the fourth pair of rollers to be higher in accordance with a detection signal detected by the fixing section discharge sensor.

8. The image forming apparatus according to claim 7, wherein a distance between the fixing section and the fourth nip portion is set to be shorter than a length in a conveying direction of the sheet having a predetermined smallest size that can be processed in the image forming apparatus.

9. The image forming apparatus according to claim 6, wherein the fixing section discharge sensor detects a rear end of a sheet.

10. The image forming apparatus according to claim 1, further comprising: a stepping motor for driving the first pair of rollers.

11. An image forming apparatus, comprising:

an image forming section for transferring a toner image onto a sheet;

a sheet feeding section including at least one supply of sheets;

a sheet conveying passage for sequentially delivering the sheets from the sheet feeding section to the image forming section;

a fixing section for fixing the toner image transferred onto the sheet at the image forming section;

a sheet discharge passage for delivering a sheet from the fixing section;

a discharging tray for receiving a sheet delivered by the sheet discharge passage;

a reversing section for reversing facing directions of front and back sides of the sheet that has had the toner image formed on the front side to enable double sided image formation;

a reversing conveying passage formed under the reversing section and disposed for putting the sheet back to the image forming section;

a switching guide for selectively diverting sheets from the sheet discharge passage for transfer toward the reversing section;

a first pair of rollers provided above the reversing section and forming a first nip for transferring sheets from the switching guide toward the reversing section;

a second pair of rollers forming a second nip and including a unit roller having on its outer peripheral surface and arc-shaped surface and a non-arc-shaped surface receded inwardly from a circle drawn continuously from the arc-shaped surface, the unit roller being selectively rotatable in a first rotational direction for receiving a sheet that has been fed toward the reversing section by the first pair of rollers and feeding the sheet to the reversing section and being selectively rotatable in a second rotational direction opposite to the first rotational direction for pulling the sheet out from the reversing section;

a third pair of rollers forming a third nip for receiving the sheet pulled out from the reversing section by the second pair of rollers and delivering the sheet to the reversing conveying passage so that an image forming is performed with respect to the backside of the sheet pulled out from the reversing section, and a rotational controller for controlling the rotating operation of the third unit roller; wherein the following mathematical relation is met:

$$x>y<z$$

where x=a distance between the first and second nips, y=an arc length of the unit roller, and z=a distance between the second and third nips, and the rotational controller causes the third unit roller to start rotating at a time immediately after a rear end of the sheet in a sheet conveying direction is out of the first nip portion, subsequently to stop after one rotation of the third unit roller so that the sheet is stopped in a state where the rear end of the sheet does not arrive at the second nip portion.

12. The image forming apparatus according to claim 11, wherein the non-arc-shaped surface includes a chord surface that is parallel to axial direction of the unit roller.

13. The image forming apparatus according to claim 11, further comprising:

a first nip sensor for detecting whether a rear end of a sheet passes through the first nip; and a rotational direction controller for causing rotation of the unit roller in the first direction in accordance with a detection of the first nip sensor.

14. The image forming apparatus according to claim 13, wherein the arc-shaped surface of the unit roller has a diameter that causes the sheet to be conveyed by one rotation of the unit roller to a position where the rear end of the sheet is positioned on an immediate upstream side of the second nip when the first nip sensor detects the rear end of the sheet.

* * * * *